US011238716B2

(12) United States Patent
Wu

(10) Patent No.: US 11,238,716 B2
(45) Date of Patent: Feb. 1, 2022

(54) PHOTOELECTRIC SMOKE FIRE DETECTION AND ALARMING METHOD, APPARATUS AND SYSTEM

(71) Applicant: Ningbo Weilaiying Electronic Technology Co., Ltd, Zhejiang (CN)

(72) Inventor: Xuedan Wu, Yuyao (CN)

( * ) Notice: Subject to any disclaimer, the term of this patent is extended or adjusted under 35 U.S.C. 154(b) by 83 days.

(21) Appl. No.: 16/918,580

(22) Filed: Jul. 1, 2020

(65) Prior Publication Data

US 2021/0158680 A1 May 27, 2021

(51) Int. Cl.
*G08B 17/107* (2006.01)
*G08B 17/113* (2006.01)

(52) U.S. Cl.
CPC ..... *G08B 17/107* (2013.01); *G08B 17/113* (2013.01)

(58) Field of Classification Search
CPC .. G08B 17/113; G08B 17/107; G08B 29/145; G08B 17/103; G08B 17/10; G08B 17/00; G01N 2015/0693; G01N 15/06
See application file for complete search history.

(56) References Cited

U.S. PATENT DOCUMENTS 4,384,488 A * 5/1983 Scheidweiler ..... G08B 17/10 73/431
4,623,878 A * 11/1986 Schoenwetter ..... A47G 33/04 340/522
5,352,901 A * 10/1994 Poorman ..... G01N 21/532 250/574
5,451,931 A * 9/1995 Muller ..... G08B 17/107 250/573
5,497,144 A * 3/1996 Schappi ..... G08B 17/107 250/574
5,596,314 A * 1/1997 Goldstein ..... H01M 50/213 340/632
8,004,416 B2 * 8/2011 Bradley, Jr. ..... G08B 17/10 340/628
2003/0132849 A1 * 7/2003 Matsukuma ..... G08B 17/113 340/630
2008/0246623 A1 * 10/2008 Nagashima ..... G08B 17/107 340/630
2008/0297361 A1 * 12/2008 Cole ..... G08B 17/107 340/630
2012/0170035 A1 * 7/2012 Dohi ..... G08B 17/107 356/343
2016/0153905 A1 * 6/2016 Allemann ..... G01N 21/53 356/338
2017/0046935 A1 * 2/2017 Allemann ..... G08B 17/103
2017/0046936 A1 * 2/2017 Aebersold ..... H01L 31/147
2021/0166542 A1 * 6/2021 Patel ..... G08B 29/145

* cited by examiner

*Primary Examiner* — Curtis J King

(57) ABSTRACT

The present invention relates to a new photoelectric smoke fire detection and alarming method, comprising: acquiring scattered light intensity data of at least two scattering angles of fire samples and interference source samples, and calculating sample parameters thereof to form a sample category table; and calculating sample parameters of detection data for comparison, and outputting a fire alarming signal when the comparison result is that the sample parameters are in line with the sample category table. According to the fire alarming method in the present invention, data collection, calculation and judgment are performed based on at least two modulated optical signals, so that the early-warning precision is improved.

20 Claims, 11 Drawing Sheets

PHOTOELECTRIC SMOKE FIRE DETECTION AND ALARMING METHOD, APPARATUS AND SYSTEM

TECHNICAL FIELD

The present invention relates to the field of fire detection and alarming technologies, and in particular, to a new photoelectric smoke fire detection and alarming method, apparatus and system.

BACKGROUND

The working principle of a conventional photoelectric smoke fire detector is based on the Lambert Beer law. When a beam of detection light passes through smoke, it is reflected or scattered to a certain scattering angle by smoke particles. The intensity of the light is measured by a photoelectric sensor to measure the relative concentration of the smoke. When the concentration of the smoke increases gradually, more light will be reflected or scattered to the photoelectric sensor, so that its output electrical signal quantity reaches a set alarming threshold, and the detector sends a fire alarming signal.

An emitting apparatus and a receiving apparatus are generally adopted in an optical maze of the conventional photoelectric smoke fire detector. The scattering angle is set to 60°, and fire early-warning detection is performed on the received signals according to a specific detection method. Generally, the detection method of the conventional photoelectric smoke fire detector mainly includes an averaging method and a continuous comparison method. The averaging method is to average multiple light intensity values (also including: a method of removing a maximum value and a minimum value), calculate an average light intensity value, compare the average light intensity value with a set threshold, and send an alarm if the average light intensity value is greater than or equal to the set threshold; otherwise, do not send any alarm. The continuous comparison method is to compare multiple light intensity values with a set threshold, and add 1 to a count value if the multiple light intensity values are greater than or equal to the set threshold; otherwise, add 0 to the count value; send an alarm when the count value reaches a set value (such as 3 or 5); otherwise, do not send any alarm.

Therefore, the conventional photoelectric smoke fire detector often sends a false alarm in actual practice.

SUMMARY

An objective of the present invention is to provide a new photoelectric smoke fire alarming method, a photoelectric smoke fire early-alarming apparatus, and a photoelectric smoke fire detection and alarming system that can well identify an interference source and a fire signal and have high detection precision.

As a first aspect of the present invention, a new photoelectric smoke fire alarming method is provided, which comprises at least the following steps.

Step 1: a data acquisition step of acquiring scattered light intensity data of samples.

Step 2: a data analysis step of obtaining sample parameters by calculation based on the acquired sample data.

Step 3: a sample table generation step of forming a number of fire categories by taking any of the sample parameters calculated in step 2 as a measurement index to obtain a sample table.

Step 4: a fire early-warning step of acquiring detection data of a to-be-detected sample collected in real time according to the method of step 1, obtaining sample parameters of the detection sample by calculation according to the method of step 2, and comparing the sample parameters with the sample table generated in step 3; and making fire early-warning judgment according to an established rule.

In other words, the sample table is made in advance according to the method of the present invention to serve as a judgment standard. In the process of daily monitoring, the sample parameters of the monitoring data collected in real time are calculated according to the method of the steps of the present invention, and then compared with the sample table. If the sample parameters correspond to a certain fire category in the sample table, it is determined as a fire and an alarm is sent. If the sample parameters are not in line with any fire category, the above single monitoring process is repeated and the mean value of each time is calculated, mean value data detected each time is compared with the sample table, and it is determined as a fire and an alarm is sent if the mean value data is in line with the sample table; if the mean value data is still not in line with the sample table, detection data is continuously collected and the calculation and comparison processes are constantly repeated, and it is determined as a fire or the environment is back to normal until the previous condition is met. Of course, single judgment may also be made on subsequent detection data monitored each time in the above monitoring process repeated multiple times; that is, in the case of repeated monitoring, fire early-warning judgment is made simultaneously for each single detection result and mean values of the multiple times.

As a second aspect of the present invention, a new photoelectric smoke fire early-alarming apparatus is provided, which comprises at least the following modules:

a data acquisition module configured to acquire scattered light intensity data of samples;

a data analysis module configured to obtain sample parameters by calculation based on the acquired sample data;

a sample table generation module configured to form a number of fire categories by taking any of the sample parameters calculated by the data analysis module as a measurement index to obtain a sample table; and a fire early-warning module configured to acquire detection data collected in real time through the data acquisition module, obtain parameters of the detection sample by calculation through the data analysis module, and compare the parameters of the detection sample with the sample table.

In the apparatus, the sample table is made in advance according to the method of the present invention to serve as a judgment standard. In the process of daily monitoring, the sample parameters of the monitoring data collected in real time are calculated according to the method of the steps of the present invention, and then compared with the sample table. If the sample parameters correspond to a certain fire category in the sample table, it is determined as a fire and an alarm is sent. If the sample parameters are not in line with any fire category, the above single monitoring process is repeated and mean values are calculated, the mean values are compared with the sample table, and it is determined as a fire and an alarm is sent if the mean values are in line with the sample table. If the mean values are still not in line with the sample table, the single monitoring process is continuously repeated and mean values of the several times are calculated, and the monitoring is continued until the mean values are in line with the sample table or the environment is back to normal.

As a third aspect of the present invention, a new photoelectric smoke fire detection and alarming system is provided, which comprises an optical detection apparatus and a detection and alarming apparatus, wherein the optical detection apparatus is configured to collect detection data, and the detection and alarming apparatus is configured to process the collected data to generate an alarming or non-alarming signal.

The detection component includes two optical signal emitting tubes and one optical signal receiving tube. The two optical signal emitting tubes and the optical signal receiving tube are fitted in a manner of scattering reception; and the detection and alarming apparatus is any of the photoelectric smoke fire detection and alarming apparatuses as described above. That is, the photoelectric smoke fire early-alarming apparatus in the second aspect and the assembly for data collection can form the photoelectric smoke fire detection and alarming system.

The fire detection and alarming method, apparatus and system according to the present invention mainly rely on the redesigned fire alarming process. By specially processing the scattered signal according to the method of the present invention, specific and more effective sample parameters are obtained, and a sample table is formed according to parameters of fire standard samples. In the case of subsequent fire detection, the detection data collected in real time is compared with the sample table to judge whether the detection data belongs to a fire. The method, apparatus and system can distinguish an interference source from a real fire, and significantly reduce the deficiency of the existing photoelectric smoke detection alarm in terms of the detection precision.

DESCRIPTION OF THE DRAWINGS

in FIG. 4*c* and FIG. 4*d*, current pulses within respective detection cycles thereof are the same, but current pulses in the two figures are mutually different;

DETAILED DESCRIPTION

Figure 1:
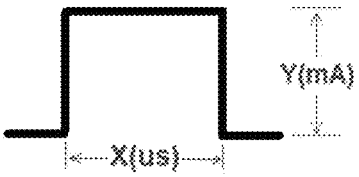
FIG. 1 is a schematic diagram of a pulse current in a conventional alarming method, wherein X(μs) is a pulse width, and Y(mA) is a pulse current value.

In order to enable those skilled in the art to better understand the present invention so as to define the protection scope of the present invention more clearly, the present invention is described in detail in the following in combination with some specific embodiments of the present invention. It should be noted that the following are only some specific implementations of the idea of the present invention and only some embodiments of the present invention. The specific and direct description of the relevant structure is only for the convenience of understanding the present invention, and various specific features do not necessarily and directly define the implementation scope of the present invention. Common choices and replacements made by those skilled in the art under the guidance of the idea of the present invention shall be considered as falling within the protection scope of the present invention.

A new photoelectric smoke fire detection and alarming method is provided, which includes at least the following steps.

Step 1: a data acquisition step of acquiring scattered light intensity data of samples. The scattered light intensity data may be acquired through an additionally disposed detection unit or obtained from the outside of the system through a data interface. In addition, the scattered light intensity data does not only refer to data generated by a scattering process of light. In fact, in the actual operation of a fire detector, scattering, reflection, diffraction and other processes often exist at the same time in different degrees as the smoke concentration varies. Considering that the fire detector is mainly intended to function at an initial stage of a fire and that the initial stage of the fire is mainly scattering, data actually received by the detection unit is summarized using scattered light intensity in the present invention. In other words, it is a detection method opposite light decay detection.

For example, scattered light intensity data of various samples collected continuously is acquired from a data collecting component, and the scattered light intensity data of each sample should include a scattered light intensity of a scattering angle θ1 and a scattered light intensity of a scattering angle θ2. On this basis, other scattered light intensity data, for example, scattered light intensity data of a scattering angle θ12, may also be included.

In order to improve the detection and alarming effect of the method, in step 1, the sample categories can specifically include a fire sample and an interference source sample, wherein the fire sample is used as a reference sample and the interference source data is used to eliminate interference. Thus, the fire sample data is processed to achieve early warning, and the interference source sample is processed to eliminate interference. Obviously, the interference source sample is not definitely necessary, but a supplementary measure to reduce the probability of false alarming. Meanwhile, when a sample table is obtained in step 3, the sample table is correspondingly caused to cover sample parameters of each sample, and any interference source sample is caused not to be in line with any fire category when compared with the sample table.

Step 2: a data analysis step of obtaining sample parameters of each sample by calculation based on the sample data and scattered light intensity data acquired in the previous step, the sample parameters including at least one of a particle size d, a refractive index m, a smoke rising rate 1, a smoke increment y, a smoke concentration a, and a smoke curvature k.

The particle size d and the refractive index m can be calculated according to the following steps:

the scattered light intensity $I_S$ satisfying: $Is=I_r+I\iota$;

where $I_r$ and Iι denote quantities perpendicular to and parallel to a scattering surface respectively, and satisfy:

$$I_r = \frac{1}{k^2r^2}\left|S_1(\theta)\right|^2 \quad I_{r0} = \frac{\lambda^2}{4\pi^2r^2}\left|S_1(\theta)\right|^2 \quad I_{r0} = \frac{\lambda^2}{4\pi^2r^2}i_1(\theta)I_0\sin^2\varphi \quad \text{(formula 1)}$$

$$I_l = \frac{1}{k^2r^2}\left|S_2(\theta)\right|^2 \quad I_{l0} = \frac{\lambda^2}{4\pi^2r^2}\left|S_2(\theta)\right|^2 \quad I_{l0} = \frac{\lambda^2}{4\pi^2r^2}i_2(\theta)I_0\cos^2\varphi$$

-continued in the above formulas, $i(\theta,\varphi)=|S(\theta,\varphi)|^2$ is an intensity function and is deduced from the following formula:

$$I_s = \frac{|S(\theta,\varphi)|^2}{k^2r^2}I_o = \frac{i(\theta,\varphi)}{k^2r^2}I_0 \quad \text{(formula 2)}$$

i1(θ) and i2(θ) are respectively:

$$i_1(\theta) = |S_1(\theta)|^2 = \left|\sum_{l=1}^{\infty}\frac{2l+1}{l(l+1)}(a_l\pi_l + b_l\tau_l)\right|^2 \quad \text{(formula 3)}$$

$$i_2(\theta) = |S_2(\theta)|^2 = \left|\sum_{l=1}^{\infty}\frac{2l+1}{l(l+1)}(a_l\tau_l + b_l\pi_l)\right|^2$$

wherein αι and bι are:

$$a_l = \frac{\psi_l(\alpha)\psi_1'(\beta) - m\psi_l'(\alpha)\psi_l(\beta)}{\zeta_l^{(1)}(\alpha)\psi_l'(\beta) - m\zeta_l^{(1)\prime}(\alpha)\psi_l(\beta)} \quad \text{(formula 4)}$$

$$b_l = \frac{m\psi_l(\alpha)\psi_l'(\beta) - \psi_l'(\alpha)\psi_l(\beta)}{m\zeta_l^{(1)}(\alpha)\psi_l'(\beta) - \zeta_l^{(1)\prime}(\alpha)\psi_l(\beta)}$$

α and β satisfy:

$\alpha=\pi d/\lambda$;

$\beta=m\alpha$;

in the above formulas, θ denotes a scattering angle, φ denotes an azimuth angle, r denotes a distance, λ denotes a detected light wavelength, all of which are known parameters, and then the particle size d and the refractive index m can be obtained by iterative calculation according to an inverse order of the above formulas in combination with the scattered light intensity $I_S$ (d and m are calculated according to an order of formulas 4321 after α and β are calculated).

In order to make the calculation more precise, the method can further include a step of light intensity correction, that is, the light intensity of the emitting tube is first measured by a calibrated instrument to obtain an actual initial intensity $I_0$, and then related sample parameters are obtained by calculation according to the actual initial intensity $I_0$ actually measured, so that the detection and alarming can be more precise.

Step 3: a sample table generation step of forming a number of fire categories by taking any (e.g., the particle size d) of the sample parameters of various samples calculated in the previous step as a measurement index, and determining values or value ranges of various sample parameters of each fire category to obtain a sample table; and causing the sample table to cover the sample parameters of various samples, that is, the sample parameters of any fire can be in line with or merely in line with a certain fire category when compared with the sample table. If the sample collected previously further includes interference source samples, any interference source sample should be compared with the sample table to make them not in line with any fire category.

The process of forming the sample table is similar to the sorting of a multi-parameter table. In principle, it is necessary to take at least a parameter as an index, such as the particle size d. However, it is also feasible to use multiple parameters at the same time, that is, if the former parameter is the same or similar, the second parameter can be further selected for subdivision and sorting to finally form a sample table.

The sample format of the method (Method 1) is: a particle size d, a refractive index m, a smoke rising slope 1, a smoke increment y, a smoke concentration a, and a smoke curvature k; and the sample table thereof can be shown in the following table form.

TABLE 1

Sample table of Method 1

| Fire category | Particle size d | Refractive index m | Smoke rising slope l | Smoke increment y | Smoke concentration a | Smoke curvature k |
|---|---|---|---|---|---|---|
| 1 | D1 | M1 | L1 | Y1 | A1 | K1 |
| 2 | D2 | M2 | L2 | Y2 | A2 | K2 |
| 3 | D3 | M3 | L3 | Y3 | A3 | K3 |
| 4 | D4 | M4 | L4 | Y4 | A4 | K4 |
| 5 | D5 | M5 | L5 | Y5 | A5 | K5 |
| 6 | D6 | M6 | L6 | Y6 | A6 | K6 |
| 7 | D7 | M7 | L7 | Y7 | A7 | K7 |
| 8 | D8 | M8 | L8 | Y8 | A8 | K8 |

Each value item can be a value or a value range, for example, D1 may be 0.01 um or 0.01-0.1 um.

In principle, the values or value ranges of various sample parameters of any fire category in the sample table only need to meet the above requirements. Specific values or value ranges of various parameters can be obtained manually or by computer iterative calculation on the basis of collecting an appropriate amount of sample data. Theoretically, more sample data will make the sample table finally obtained more precise, and at the same time, the amount of calculation will also be correspondingly increased. Therefore, the types and numbers of the samples can be selected correspondingly according to the requirements of early-warning precision or use scenarios. It should be noted that the quantity of the samples not only refers to the quantity of combustibles selected for testing, but also includes repeated experimental data for the same combustible under the same or different conditions.

The fire sample may include at least one or all of smoldering fire of 10 pieces of wood, smoldering fire of 90 cotton ropes, open fire of polyurethane plastics, open fire of n-heptane, open fire of 70 pieces of thin wood, open fire of decalin, open fire of newspaper, smoldering fire of 18 pieces of thin wood, open fire of foam, smoldering fire of foam, clothes, shoes, composite boards, books, packing boxes, and plush toys. The interference source sample can include at least one of water vapor, salt fog, kitchen fume, powder, dust, dirt, hair, spider silk and small insects. In fact, by incorporating the sample types required by the regulations into the fire sample, the products can directly meet the requirements of the regulations. At the same time, the addition of conventional interference sources can greatly reduce the probability of false alarming.

The fire sample and the interference source sample used in the method of the present invention can be set as follows.

The fire sample may include: smoldering fire of 10 pieces of wood, smoldering fire of 90 cotton ropes, open fire of polyurethane plastics, open fire of n-heptane, open fire of 70 pieces of thin wood, open fire of decalin, open fire of newspaper, smoldering fire of 18 pieces of thin wood, open fire of foam, smoldering fire of foam, and other fire samples stipulated in the regulations such as CCCF, EN, and UL for data collection, so that the product of the alarming method meets the relevant requirements of the regulations; and fire data samples are created in a limit state. In addition to this, fire experiments can also be conducted on common materials in daily life to acquire fire data (that is, sample materials include common materials), for example, clothes, shoes, synthetic boards, books, packing boxes, plush toys and so on.

For the collection of interference source data, data of interference sources such as water vapor, salt fog, kitchen fume, powder, dust, dirt (suspended particles), hair, spider silk and small insects can be collected, and interference source samples can be created in a limited state.

Step 4: a fire early-warning step of collecting detection data in real time according to the method of step 1, processing the detection data according to the method of step 2 to obtain sample parameters of a to-be-detected sample, and comparing the sample parameters with the sample table obtained in step 3.

If the parameters are in line with the parameters of a fire category, it is determined as a fire and an early-warning signal is sent. If the parameters are not in line with the parameters of any fire category, the above processes are repeated at least twice to calculate mean values, and the mean values are used for comparison. If the mean values are in line with the parameters of a fire category, it is determined as a fire and an early-warning signal is sent. If the mean values are still not in line with the parameters of any fire category, the collection is performed continuously and mean value calculation and comparison are constantly repeated until it is determined as a fire and an early-warning signal is sent after the mean values are in line with the parameters of a fire category; otherwise, the monitoring is continued. Meanwhile, single comparison and determination are also made on data for each detection in multiple detection processes.

The method can be implemented in two parts in practice.

In the first part, the sample table is obtained according to steps 1-3, and stored for backup. The sample table can be stored in the cloud and read through a data link (a 4G network, WIFI and other existing mature communication technologies), and can be fixedly stored in a storage media of the alarm, or stored on a removable media such as a USB flash drive. These three storage manners have their own advantages and disadvantages (the cloud is convenient for optimization and upgrading, but a communication module needs to be added thereto, fixed storage has lower costs but is not conducive to upgrading, and the removable media will also have hardware costs), which can be selected according to requirements. Of course, the actual storage manner is not limited to this, which can also be another manner that can implement the method of the present invention.

In the second part, in the detection and alarming process after the installation is completed, when the method is enabled, detection data is collected in real time according to the method of step 1, then the detection data is calculated and processed according to the method of step 2 to obtain parameters of a detection sample, finally the obtained parameters of the detection sample are compared with the sample table stored in the first part, and judgment is made according to an established comparison method. If the judgment result is that the parameters are in line with the sample table, an early-warning signal is output, and if the parameters are not in line with the sample table, monitoring and judgment are continued.

A new photoelectric smoke fire detection and alarming method is wholly the same as the above method, and the difference only lies in that in the method, step 2 is changed appropriately to make the sample parameters include at least one of a light intensity ratio n, particle distribution e, a smoke rising slope 1, a smoke increment y, a smoke concentration a, and a smoke curvature k (that is, the original step 2 is replaced with a new step 2).

The light intensity ratio n and the particle distribution e can be calculated according to the following steps:

the light intensity ratio n satisfying:

$n=I_S1/I_S2$;

where $I_S1$ denotes the scattered light intensity of the scattering angle θ1, and $I_S2$ denotes the scattered light intensity of the scattering angle θ2; and the particle distribution e satisfying:

e=D(d, m); or e=D(n), where d denotes a particle size of a particle, m denotes the refractive index, and n denotes the light intensity ratio; the calculation method is the same as above.

The sample format used by the method (hereinafter referred to as Method 2) is: a light intensity ratio n, particle distribution e, a smoke rising slope 1, a smoke increment y, a smoke concentration a, and a smoke curvature k; and the sample table formed in step 3 may be the following table form:

TABLE 2

Sample table of Method 2

| Fire category | Light intensity ratio n | Particle distribution e | Smoke rising slope l | Smoke increment y | Smoke concentration a | Smoke curvature k |
|---|---|---|---|---|---|---|
| 1 | N1 | E1 | L1 | Y1 | A1 | K1 |
| 2 | N2 | E2 | L2 | Y2 | A2 | K2 |
| 3 | N3 | E3 | L3 | Y3 | A3 | K3 |
| 4 | N4 | E4 | L4 | Y4 | A4 | K4 |
| 5 | N5 | E5 | L5 | Y5 | A5 | K5 |
| 6 | N6 | E6 | L6 | Y6 | A6 | K6 |
| 7 | N7 | E7 | L7 | Y7 | A7 | K7 |
| 8 | N8 | E8 | L8 | Y8 | A8 | K8 |

Similarly, each value item in the above table can also be a value or a value range.

The smoke rising rate 1, the smoke increment y, the smoke concentration a, and the smoke curvature k in the above related step are calculated according to the following methods.

Figure 2:
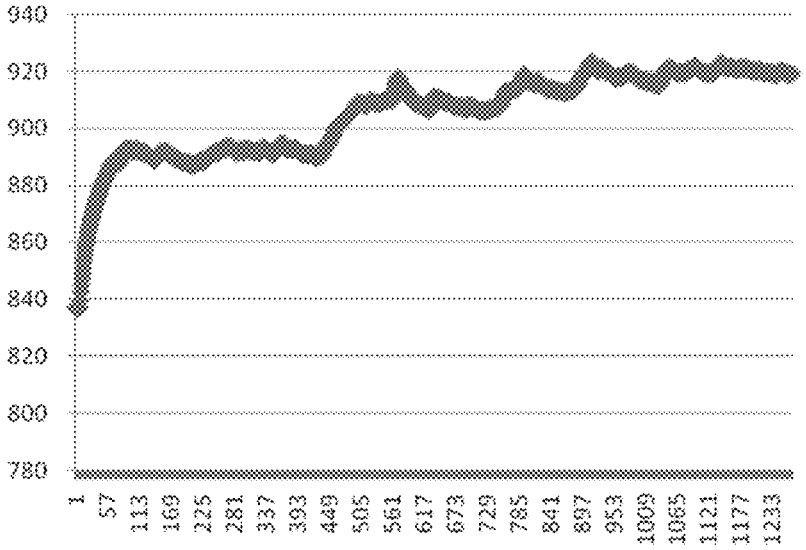
FIG. 2 is a data curve of scattered light intensities of fire smoke particles according to an embodiment of the present invention, wherein the X axis is time, and the Y axis is intensity values.
Figure 3:
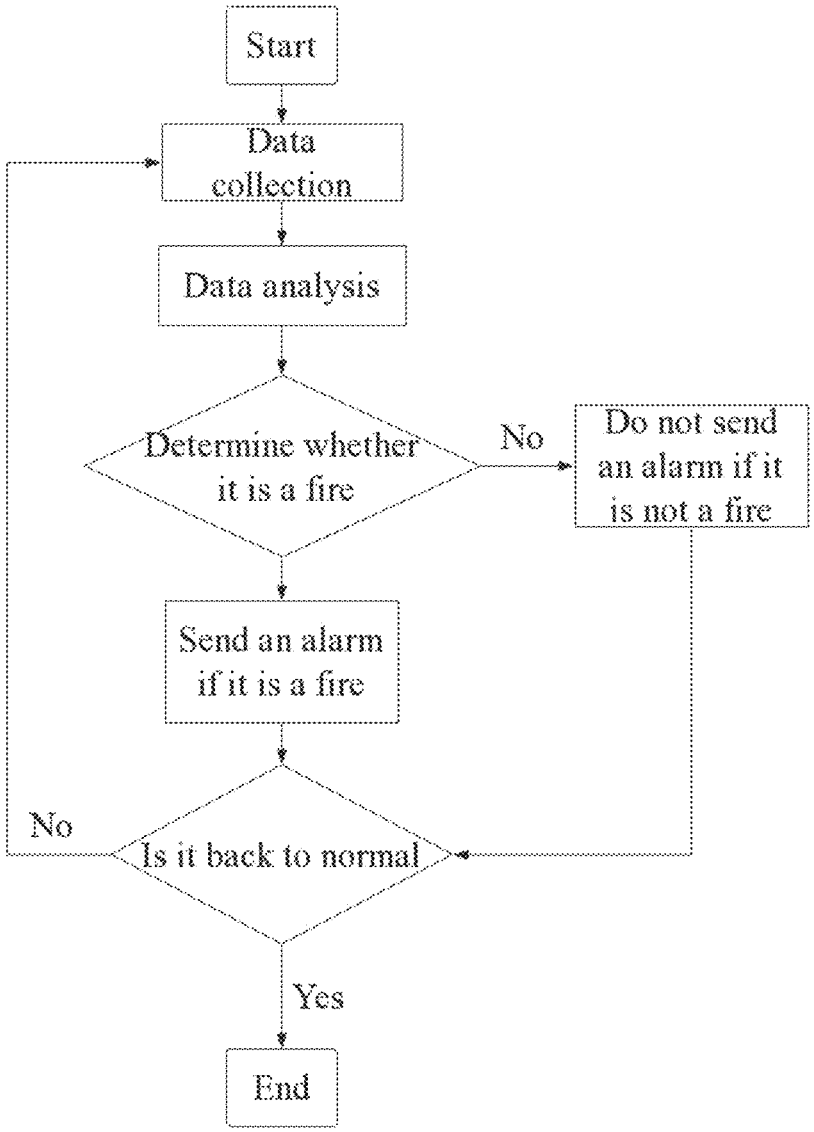
FIG. 3 is a schematic flowchart of a working process of a fire detection and alarming system according to the present invention.
Figure 4A:
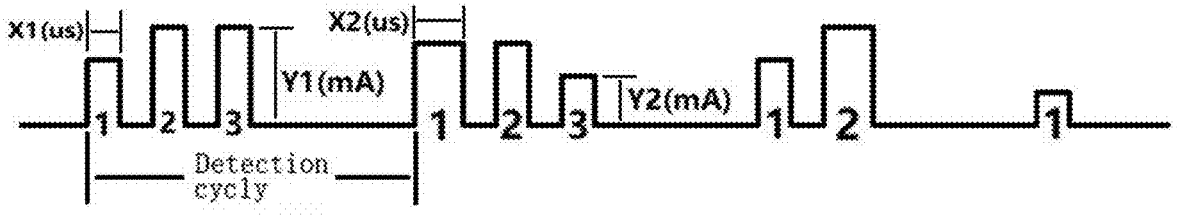
FIGS. 4*a*-4*d* are a schematic diagram of a pulse current cycle of a fire detection and alarming system according to some embodiments of the present invention, wherein in FIG. 4*a* and FIG. 4*b*, the quantity and parameters (width and current value) of current pulses within each detection cycle are not exactly the same, nor are the two.
Figure 4B:
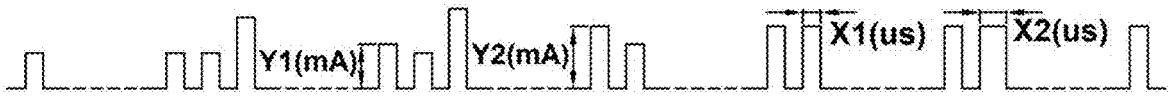
Figure 4C:
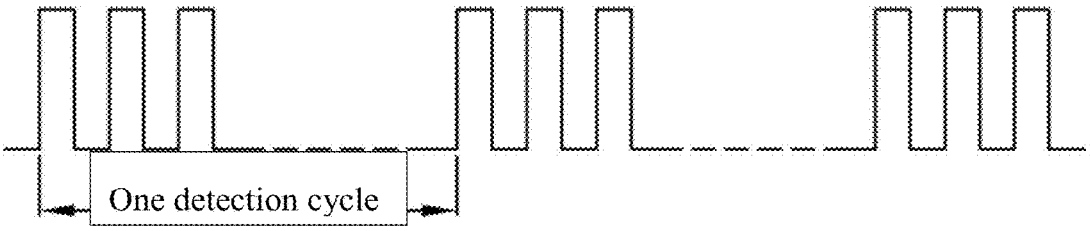
Figure 4D:
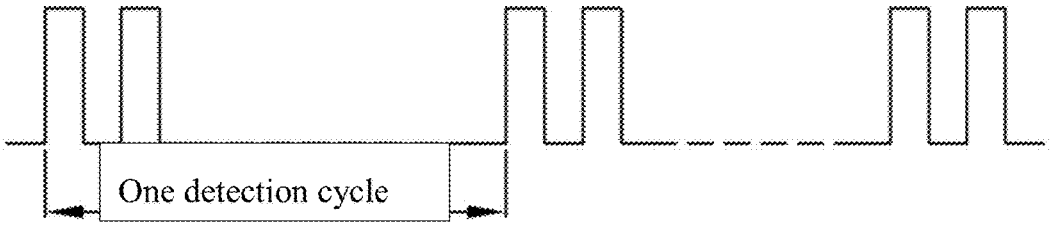

Firstly, a data curve of scattered light intensities of fire smoke particles is drawn by taking time as a horizontal axis and light intensity values as a vertical axis, as shown in FIG. 2.

Then, the smoke rising slope 1, the smoke increment y, the smoke concentration a, and the smoke curvature k are calculated according to the drawn data curve of the scattered light intensities of the fire smoke particles. In the curve, a slope from a point A to a point B of the light intensity curve is taken as the smoke rising slope 1, an increment from the point A to the point B of the light intensity curve is taken as the smoke increment y, the value of a point a on the light intensity curve is taken as the smoke concentration a, and a change rate between a point k1 and a point k2 of the light intensity curve is taken as the smoke curvature.

The above are two exemplary practical methods of the method of the present invention, of which one is a method composed of the steps 1, 2, 3 and 4, and the other is a method composed of the step 1, the new step 2, and the steps 3 and 4. The difference between the two methods is that the sample parameters used in step 2 are different, the former includes a particle size d, a refractive index m, a smoke rising rate 1, a smoke increment y, a smoke concentration a, and a smoke curvature k, while the latter includes a light intensity ratio n, particle distribution e, a smoke rising rate 1, a smoke increment y, a smoke concentration a, and a smoke curvature k. Moreover, their amounts of computation are also different. The two alarming methods are different in that the calculation manners are different and thus the requirements on hardware are different. Upon comparison, the latter has lower requirements on hardware. This is mainly because the calculation process is iterative calculation, for example, values of d and m are set first, α and β are calculated, $I_r+I_t$ is calculated according to the formula 4, the formula 3, the formula 2 and the formula 1 in sequence, and the scattered light intensity $I_S$ is obtained finally and compared with the collected scattered light intensity $I_S$. Such an iterative calculation process is repeated until d and m are obtained. Therefore, the latter method can save some amount of computation, which has lower requirements on hardware and is more efficient.

In addition, although there are similarities and differences between the contents of the sample parameters in the above two methods and the two are distinguished by Method 1 and Method 2, it does not mean that the sample parameters in the method of the present invention can only be these or only can be combined in this manner. In fact, the sample parameters on which the method of the present invention is based can be further evolved and combined on the basis of the above two methods, which does not affect the implementation of the method of the present invention.

The sample table can be compared using an exact numerical correspondence method or a weight assignment method. The former means that when various sample parameters of a to-be-compared sample (i.e., a detection sample) are completely consistent with various sample parameters of a certain fire category in the sample table (or within its range, mainly when the sample parameters are range values), it is determined that the sample parameters are in line with the fire category. The weight assignment method refers to assigning the overall weight of each sample parameter in the sample table. During comparison, a fit degree between a detection sample and any fire category is reflected in the form of a ratio. When the ratio exceeds a set threshold, it is determined that the detection sample is in line with the fire category. If a sample is in line with multiple fire categories at the same time, the highest ratio shall be used for judging the fire category finally.

For example, for the sample table in Method 1, weights of 40%, 30%, 5%, 3%, 20% and 2% are respectively assigned to the particle size d, the refractive index m, the smoke rising slope 1, the smoke increment y, the smoke concentration a, and the smoke curvature k. It is found after the comparison between the corresponding sample parameters of a detection sample with the sample table that the sample parameters are in line with the particle size d, the refractive index m, the smoke rising slope 1, and the smoke concentration a of the fire category 3, but not in line with the other two items, then the fit degree between the detection sample and the fire category is 40%+30%+5%+20%=95%, and the set threshold is 85%; thus, it is determined that the detection sample is in line with the fire of the fire category 3.

For the weight assignment method, a specific weight value and a fit threshold of each parameter can be set according to requirements. For example, parameters such as the particle size d, the refractive index m, the smoke concentration a (for Method 1), the light intensity ratio n, the particle distribution e, and the smoke concentration a (for Method 2) are the most important; and their weights should not be less than 70% in principle.

Preferably, in step 1, the scattered light intensity data of each sample includes at least a scattered light intensity of a scattering angle θ1, a scattered light intensity of a scattering angle θ2 and scattered light intensity data of a scattering angle θ12, that is, scattered signals generated by two emitting apparatuses at different positions and angles. Optimally, the scattered light intensity data is acquired after dynamically modulated optical signals are scattered, and pulse timing sequences, pulse widths and pulse current values of the optical signals at the scattering angle θ1 and the scattering angle θ2 are adjustable.

In some other preferred embodiments, the method further includes an exiting step and a daily monitoring step so that the method has two detection methods with different precisions. In the daily monitoring, a fire can be preliminarily detected by a simpler detection method. Once the conditions are met, the precise detection method of the above steps 1 to 4 can be started again. Thus, the detection precision, efficiency and energy consumption can be taken into account.

Step 5: an exiting step of comparing the detection data (for example, the light intensity value) acquired in step 4 with a set threshold if it is not determined as a fire in step 4; if the detection data is less than the set threshold, determining that the environment is back to normal, and exiting the method of step 1 to step 4 (the precise detection method); if the detection data is greater than or equal to the set threshold, determining that the environment is not back to normal, repeating the step of fire early-warning in step 4 until the detection data is less than the set threshold, and exiting the step.

Step 6: a daily monitoring step of collecting scattered light intensity data at regular intervals, for example, collecting the scattered light intensity data every 3 s, 5 s or at a longer interval, and comparing the scattered light intensity value with a set threshold; if the collected value is greater than or equal to the set threshold, performing the fire early-warning step of step 4 to start precise detection; and if the collected value is less than the set threshold, repeating the step to perform daily monitoring until the collected value is greater than or equal to the set threshold, and starting the precise detection.

Alternatively, an actual increment of the acquired scattered light intensity value relative to an environmental reference value is compared with a set increment threshold; if the actual increment is greater than or equal to the increment threshold, the detection and alarming method of step 1 to step 4 is performed. If the actual increment is less than the increment threshold, the step is repeated until the detection and alarming method of step 1 to step 4 is started. That is, an incremental judgment method based on environment correction is adopted. In daily monitoring, the environmental value of the fire alarm will tend to increase as the use time is increased. Thus, in daily monitoring, daily monitoring values without alarm are used to constantly correct the environmental reference value so that the data is more objective and reasonable, and judgment is made by monitoring a data increment change, rather than a specific threshold value, which is more accurate and effective.

Obviously, in daily monitoring, the structure that compares only the scattered light intensity data with the set threshold is rough and susceptible to interference, and the existing similar detection and alarming methods cannot solve the defects of detection precision and anti-interference no matter how they are optimized. In the method of the present invention, they are used as a precursor of the precise detection method and daily monitoring, and the shortcomings of the method are made up through a newly designed precise detection method, so that after they are combined for use, there is great progress in detection precision, anti-interference, energy consumption, and other aspects, thus forming a brand-new fire detection and alarming method with excellent practical effects.

In other words, the method of step 1 to step 4 in the present invention can be regarded as a precise detection and alarming method, which, after being installed and started, can work continuously to carry out fire early-warning monitoring all the time. As such, it has a good early-warning effect, but consumes a lot of power and costs a lot. The added method of steps 5 and 6 is to provide a trigger (or activation) mechanism, which is similar to the light intensity mode of the conventional alarm in daily monitoring. When the light intensity reaches a certain threshold, the precise detection and alarming method of the present invention is started for precise fire early-warning. Of course, on the basis of not deviating from the purpose of the method of the present invention, other working modes can also be set according to requirements, such as starting the precise detection and alarming method regularly.

A new photoelectric smoke fire early-alarming apparatus is provided, which includes at least the following modules.

A data acquisition module configured to acquire scattered light intensity data of samples. The scattered light intensity data may be acquired either through an additionally added detection unit or obtained from the outside of the system through a data interface. The scattered light intensity data does not only refer to light data generated by a scattering process of light. In fact, in the actual operation of a fire detector, scattering, reflection, diffraction and other processes often exist at the same time in different degrees as the smoke concentration varies. Considering that the fire detector is mainly intended to function at an initial stage of a fire and that the initial stage of the fire is mainly scattering, data actually received by the detection unit is summarized using scattered light intensity in the present invention.

A data analysis module configured to obtain sample parameters by calculation based on the acquired sample data, the sample parameters including at least one of a particle size d and a refractive index m.

A sample table generation module configured to form a number of fire categories by taking any of the sample parameters calculated by the data analysis module as a measurement index, and determine values or value ranges of various sample parameters of each fire category to obtain a sample table that covers the sample parameters. Of course, the process of forming the sample table is similar to the sorting of a multi-parameter table. In principle, it is necessary to take at least a parameter as an index, such as the particle size d. However, it is also feasible to use multiple parameters at the same time, that is, if the former parameter is the same or similar, the second parameter can be further selected for subdivision and sorting to finally form a sample table.

A fire early-warning module configured to acquire detection data collected in real time through the data acquisition module, obtain parameters of the detection sample by calculation through the data analysis module, and compare the parameters of the detection sample with the sample table.

If the parameters are in line with the parameters of a fire category, it is determined as a fire and an early-warning signal is sent. If the parameters are not in line with the parameters of any fire category, the above processes are repeated at least twice to calculate mean values, and the mean values are used for comparison. If the mean values are in line with the parameters of a fire category, it is determined as a fire and an early-warning signal is sent. If the mean values are still not in line with the parameters of any fire category, the collection is performed continuously and mean value calculation and comparison are constantly repeated until it is determined as a fire and an early-warning signal is sent after the mean values are in line with the parameters of a fire category; otherwise, the monitoring is continued. Meanwhile, single comparison and determination are also made on data for each detection in multiple detection processes.

In the apparatus, the sample table is made in advance according to the method of the present invention to serve as a judgment standard. In the process of daily monitoring, the sample parameters of the monitoring data collected in real time are calculated according to the method of the steps of the present invention, and then compared with the sample table. If the sample parameters correspond to a certain fire category in the sample table, it is determined as a fire and an alarm is sent. If the sample parameters are not in line with any fire category, the above single monitoring process is repeated and mean values are calculated, the mean values are compared with the sample table, and it is determined as a fire and an alarm is sent if the mean values are in line with the sample table; if the mean values are still not in line with the sample table, the single monitoring process is continuously repeated and mean values of several times are calculated, and the monitoring is continued until the mean values are in line with the sample table or the environment is back to normal.

In the data analysis module, the particle size d and the refractive index m may be calculated according to the following methods respectively:

the scattered light intensity $I_S$ satisfying: $Is=I_r+I\iota$;

where $I_r$ and $I\iota$ denote quantities perpendicular to and parallel to a scattering surface respectively, and satisfy:

$$I_r = \frac{1}{k^2r^2}|S_1(\theta)|^2 I_{r0} = \frac{\lambda^2}{4\pi^2r^2}|S_1(\theta)|^2 I_{r0} = \frac{\lambda^2}{4\pi^2r^2} i_1(\theta) I_0 \sin^2\varphi$$

$$I_l = \frac{1}{k^2r^2}|S_2(\theta)|^2 I_{l0} = \frac{\lambda^2}{4\pi^2r^2}|S_2(\theta)|^2 I_{l0} = \frac{\lambda^2}{4\pi^2r^2} i_2(\theta) I_0 \cos^2\varphi$$

in the above formulas, $i(\theta,\varphi)=|S(\theta, \varphi)|^2$ is an intensity function and is deduced from the following formula:

$$I_s = \frac{|S(\theta, \varphi)|^2}{k^2r^2} I_0 = \frac{i(\theta, \varphi)}{k^2r^2} I_0$$

$i1(\theta)$ and $i2(\theta)$ are respectively:

$$i_1(\theta) = |S_1(\theta)|^2 = \left|\sum_{l=1}^{\infty} \frac{2l+1}{l(l+1)}(a_l\pi_l + b_l\tau_l)\right|^2$$

-continued $$i_2(\theta) = |S_2(\theta)|^2 = \left|\sum_{l=1}^{\infty} \frac{2l+1}{l(l+1)}(a_l\tau_l + b_l\pi_l)\right|^2$$

wherein $\alpha\iota$ and $b\iota$ are:

$$a_l = \frac{\psi_l(\alpha)\psi_1'(\beta) - m\psi_l'(\alpha)\psi_l(\beta)}{\zeta_l^{(1)}(\alpha)\psi_l'(\beta) - m\zeta_l^{(1)\prime}(\alpha)\psi_l(\beta)}$$

$$b_l = \frac{m\psi_l(\alpha)\psi_l'(\beta) - \psi_l'(\alpha)\psi_l(\beta)}{m\zeta_l^{(1)}(\alpha)\psi_l'(\beta) - \zeta_l^{(1)\prime}(\alpha)\psi_l(\beta)}$$

$\alpha$ and $\beta$ satisfy:

$\alpha=\pi d/\lambda$;

$\beta=m\alpha$;

in the above formulas, $\theta$ denotes a scattering angle, $\varphi$ denotes an azimuth angle, r denotes a distance, $\lambda$ denotes a detected light wavelength, all of which are known parameters, and then the particle size d and the refractive index m can be obtained by iterative calculation according to an inverse order of the above formulas in combination with the scattered light intensity $I_S$.

In the data acquisition module, the samples include fire samples and interference source samples. In the sample table generation module, when the sample table is obtained, the sample table is caused to cover sample parameters of each sample and any interference source sample is caused to be not in line with any of the fire categories upon comparison with the sample table. More preferably, the fire sample includes smoldering fire of 10 pieces of wood, smoldering fire of 90 cotton ropes, open fire of polyurethane plastics, open fire of n-heptane, open fire of 70 pieces of thin wood, open fire of decalin, open fire of newspaper, smoldering fire of 18 pieces of thin wood, open fire of foam, smoldering fire of foam, clothes, shoes, composite boards, books, packing boxes, and plush toys. The interference source sample includes water vapor, salt fog, kitchen fume, powder, dust, dirt, hair, spider silk and small insects.

A new photoelectric smoke fire detection and alarming apparatus is wholly the same as the above apparatus, and the difference only lies in that in the apparatus, the data analysis module is changed appropriately so that the sample parameters include at least one of a light intensity ratio n, particle distribution e, a smoke rising slope 1, a smoke increment y, a smoke concentration a, and a smoke curvature k (that is, the original data analysis module is replaced with a new data analysis module).

The data analysis module is replaced with:

a data analysis module configured to obtain sample parameters by calculation based on the acquired sample data, the sample parameters including at least one of a light intensity ratio n and particle distribution e.

Preferably, the light intensity ratio n and the particle distribution e are calculated according to the following methods respectively:

the light intensity ratio n satisfying:

$n=I_S1/I_S2$;

where $I_S1$ denotes the scattered light intensity of the scattering angle $\theta1$, and $I_S2$ denotes the scattered light intensity of the scattering angle $\theta2$; and the particle distribution e satisfying:

$e=D(d, m)$; or $e=D(n)$, where d denotes a particle size of a particle, m denotes the refractive index, and n denotes the light intensity ratio.

The smoke rising rate 1, the smoke increment y, the smoke concentration a, and the smoke curvature k can be calculated according to the following methods respectively:

firstly, drawing a data curve of scattered light intensities of fire smoke particles by taking time as a horizontal axis and light intensity values as a vertical axis; and then, in the drawn data curve of the scattered light intensities of the fire smoke particles, taking a slope from a point A to a point B of the light intensity curve as the smoke rising slope 1, taking an increment from the point A to the point B of the light intensity curve as the smoke increment y, taking the value of a point a on the light intensity curve as the smoke concentration a, and taking a change rate between a point k1 and a point k2 of the light intensity curve as the smoke curvature.

Preferably, the scattered light intensity data of each sample includes at least a scattered light intensity of a scattering angle θ1 and a scattered light intensity of a scattering angle θ2. Optimally, the scattered light intensity data of each sample further includes scattered light intensity data of a scattering angle θ12.

In some other preferred embodiments, the apparatus further includes an exit judging module and a daily monitoring module, so that the method has two detection methods with different precisions. In the daily monitoring, a fire can be preliminarily detected by a simpler detection method. Once the conditions are met, the precise detection method of the above steps 1 to 4 can be started again. Thus, the detection precision, both efficiency and energy consumption can be taken into account. Of course, the apparatus may not include the exit judging module and the daily monitoring module, and only performs daily monitoring through the above precise detection apparatus, which is only insufficient in terms of energy consumption performance.

The exit judging module is configured to judge whether to exit the fire early-warning module, compare the acquired detection data with a set threshold if the fire early-warning module determines that it is not a fire; if the detection data is less than the set threshold, determine that the environment is back to normal, and exit the fire early-warning module; if the detection data is greater than or equal to the set threshold, determine that the environment is not back to normal, continue the execution of the fire early-warning module until the detection data is less than the set threshold, and exit the fire early-warning module.

The daily monitoring module is configured to perform monitoring in a daily non-fire situation; compare scattered light intensity data collected regularly with a set threshold; if the collected value is greater than or equal to the set threshold, start the execution of the fire early-warning module; and if the collected value is less than the set threshold, repeat the execution of the daily monitoring module until the collected value is greater than or equal to the set threshold, and start precise detection; or compare an actual increment of the collected scattered light intensity value relative to an environmental reference value with an increment threshold; if the actual increment is greater than or equal to the increment threshold, start the execution of the fire early-warning module; and if the actual increment is less than the increment threshold, repeat the execution of the daily monitoring module.

Obviously, in daily monitoring, the structure that compares only the scattered light intensity data with the set threshold is rough and susceptible to interference, and the existing similar detection and alarming methods cannot solve the defects of detection precision and anti-interference no matter how they are optimized. In the method of the present invention, they are used as a precursor of the precise detection method and daily monitoring, and the shortcomings of the method are made up through a newly designed precise detection method, so that after they are combined for use, there is great progress in detection precision, anti-interference, energy consumption, and other aspects, thus forming a brand-new fire detection and alarming method with excellent practical effects.

A new photoelectric smoke fire detection and alarming system is provided, which includes an optical detection apparatus and a detection and alarming apparatus. The optical detection apparatus is configured to collect detection data through an optical signal, and the detection and alarming apparatus is configured to process the collected data to generate an alarming or non-alarming signal (which may also be referred to as an early-warning signal). The optical detection apparatus should include at least two optical signal emitting tubes and one optical signal receiving tube. The two optical signal emitting tubes and the optical signal receiving tube are fitted in a manner of scattering reception. The detection and alarming apparatus is any of the photoelectric smoke fire early-alarming apparatuses in any of the embodiments described above to form the new photoelectric smoke fire detection and alarming system.

Figure 6A:
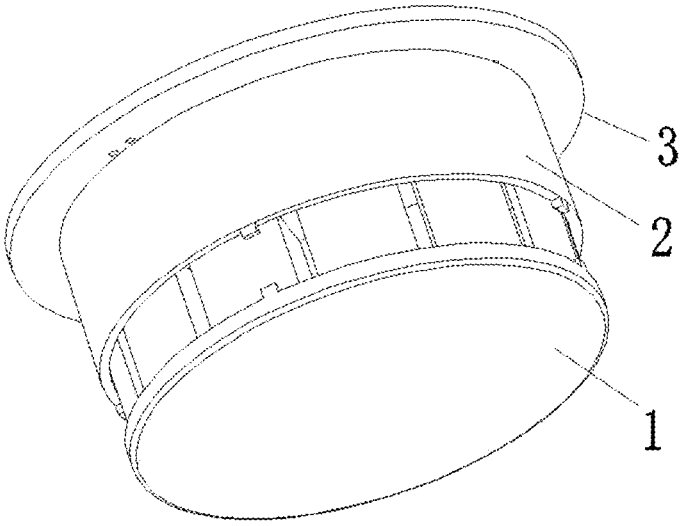
FIG. 6*a* is a schematic structural diagram of a detection apparatus of an alarming system according to another preferred embodiment of the present invention.
Figure 6B:
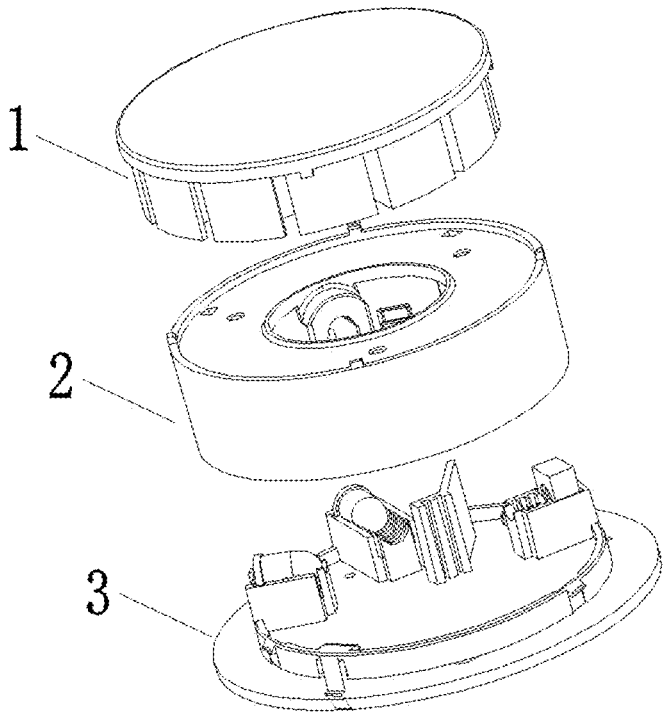
FIG. 6*b* is a schematic exploded structural diagram of the detection apparatus in the embodiment of FIG. 6*a;*
Figure 6C:
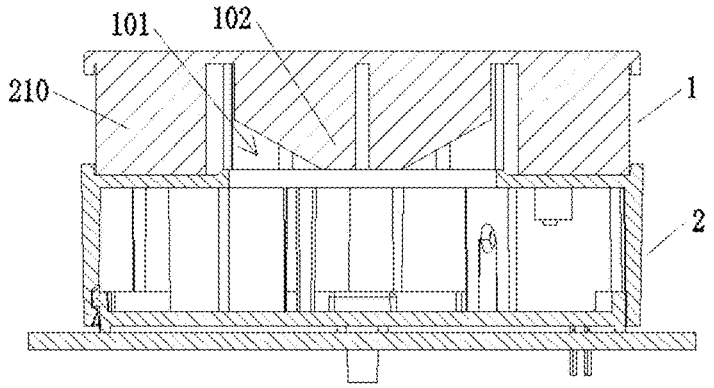
FIG. 6*c* is a sectional diagram of the detection apparatus in the embodiment of FIG. 6*a;*

As shown in FIG. 6, in some other embodiments, the optical detection apparatus is composed of an optical maze 1, an upper cover 2, and a detection component 3.

The optical maze 1 includes a base 100. A maze part is disposed on one side of the base 100 close to the detector. The maze part has a maze passage 300. Without considering the connectivity of the maze passage 300, the cross-section shape of the maze part can preferably be an annular, polygonal or elliptical shape with a closed boundary. In other words, the inside and the outside of the maze part can be communicated only through the maze passage 300.

The base 100 is used to be fitted to the detection component 3 to reflect the external light entering the detection component 3, reduce the interference of the external light with the alarm, and improve the early-warning accuracy of the fire alarm. A maze part is disposed on one side of the base 100. The maze part isolates the outside world from the detection component so that the detection component is not interfered by the external light, and meanwhile, the maze part allows the gas to pass through it to be detected by the detection component.

Figure 5A:
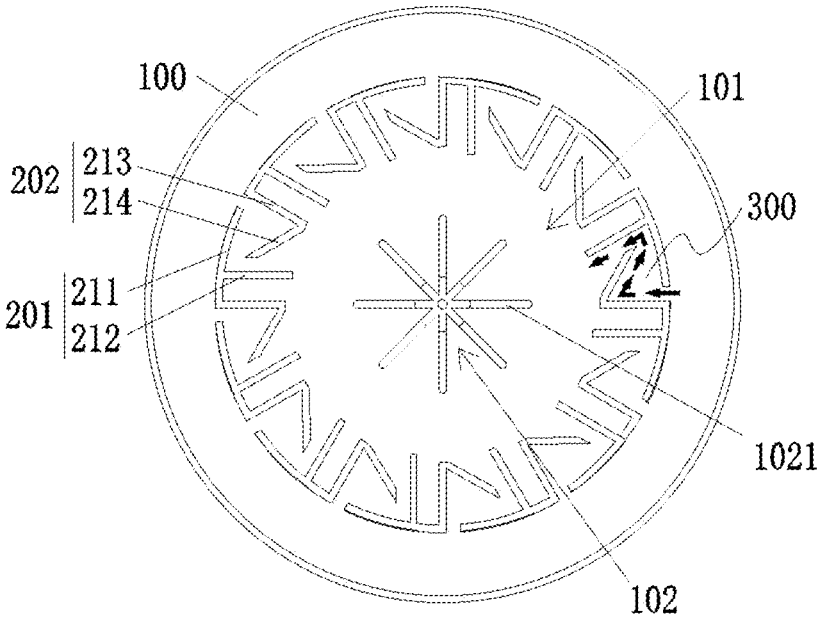
FIG. 5*a* is a schematic top structural diagram of an optical maze according to an embodiment of the present invention, in which in order to ensure a closing effect of a maze part, a connecting part is further provided between a first blocking part and a second blocking part of each maze passage, so that the whole maze part is sealed except the maze passage, wherein the black arrow represents a schematic diagram of a flow process of an external gas (that is, to-be-detected gas) entering into a chamber.
Figure 5B:
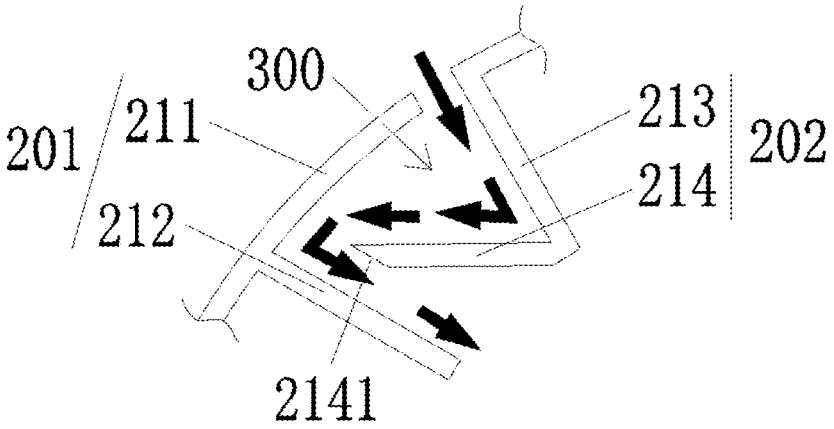
FIG. 5*b* is a schematic structural diagram of the maze passage in the embodiment of FIG. 5*a*, and is an enlarged schematic diagram of a partial structure of the structure of a certain maze part, in which the black arrow is also used to represent a flow process of the entering of an external gas.

As shown in FIG. 5, in some embodiments, the maze part has a maze passage 300. The maze passage 300 is formed by fitting a first blocking part 201 and a second blocking part 202. The first blocking part 201 and the second blocking part 202 are protruded on the surface of the base 100. The first blocking part 201 includes a first mound 211 and a second mound 212. The second blocking part 202 includes a third mound 213 and a fourth mound 214. An included angle between the first mound 211 and the second mound 212 is an acute angle, which is preferably 30-60° and optimally 45°. An included angle between the third mound 213 and the fourth mound 214 is 45-120°. Moreover, after the first blocking part 201 and the second blocking part 202 are fitted, the fourth mound 214 is extended into a region between the first mound 211 and the second mound 212.

The first blocking part 201 and the second blocking part 202 may be made separately and fitted to the base 100 by welding, bonding, clamping, etc., or they may be integrally formed with the base 100, preferably.

Optimally, the fourth mound 214 is extended to or near a junction between the first mound 211 and the second mound 212 to form a maze passage in a Z shape or similar to a Z shape. In principle, the extending position of the fourth mound 214 in the region between the first mound 211 and the second mound 212 can be varied, but in terms of an actual effect, the extension of the fourth mound 214 to or near their joint can minimize the interference of the external light to the detection component without affecting the gas circulation effect, which is the best solution. In this case, the tail of the fourth mound 214 can be disposed in parallel to the second mound 212 to form a parallel part 2141 to reduce the adverse effect on the gas passage.

The narrowest width of the maze passage 300 should not be less than 1 mm to ensure the gas exchange effect between the inside and the outside. That is, a distance between the front end of the first mound 211 and the third mound 213 as well as a distance between the tail of the fourth mound 214 and the first mound 211 or the second mound 212 should not be less than 1 mm to ensure a sufficient gas exchange effect inside and outside the fire alarm. More preferably, the narrowest width of the maze passage 300 is not less than 3 mm.

When the above structure is satisfied, the cross-section shapes of the first mound 211, the second mound 212, the third mound 213, and the fourth mound 214 can be linear, arc-shaped or wavy respectively, which can implement the maze function of the utility model. Specific selections and combinations are not limited here.

The cross-section shape of the maze part can be a closed integral shape such as a circle, polygon or oval shape. That is, the maze part is a sealed shape if the maze passage 300 is not taken into account. A connecting part is further provided between the first blocking part 201 and the second blocking part 202 of each maze passage 300, so that the whole maze part is sealed except the maze passage. For example, as shown in FIG. 5, the second blocking part 202 of the previous maze passage 300 is connected to the first blocking part 201 of the next maze passage to close the gap between the two, forming a basic composition unit similar to a "it" shape.

More preferably, the optical maze further includes a chamber 101. The detection component is in communication with the chamber 101. The chamber 101 is provided at a central position (which only refers to a relative position, rather than the conventional "center point" or "center area") of the maze part that forms a closed shape so that the chamber 101 can be connected to the outside world via the maze passage 300.

In order to prevent the external gas (that is, to-be-detected ambient gas) from directly flowing out from the maze passage 300 on the other side to reduce the detection effect after it enters the maze passage 300 from one side of the maze and passes through the chamber 101 (of course, which can also flow out from the maze passage 300 in another direction). A guide member 102 can be disposed in the chamber 101, which includes a number of guide vanes 1021 to make the external gas change the direction to flow towards the detection component along the axis of the optical maze after it enters the chamber 101. Meanwhile, such a change can also greatly reduce the interference of the external light with the detector.

Figure 7A:
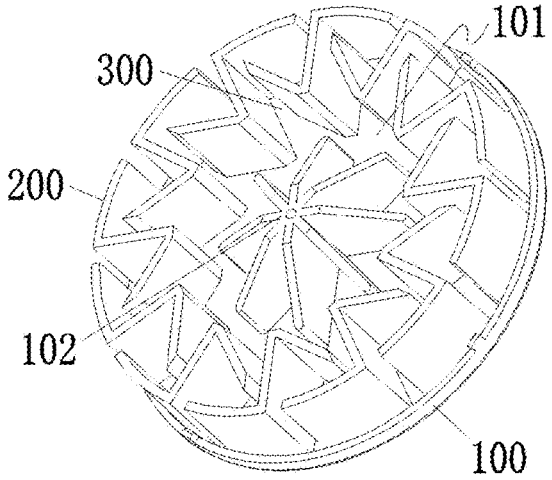
FIG. 7*a* and FIG. 7*b* are schematic structural diagrams of the front and the back of the maze structure of the detection apparatus in the embodiment of FIG. 5 respectively.
Figure 7B:
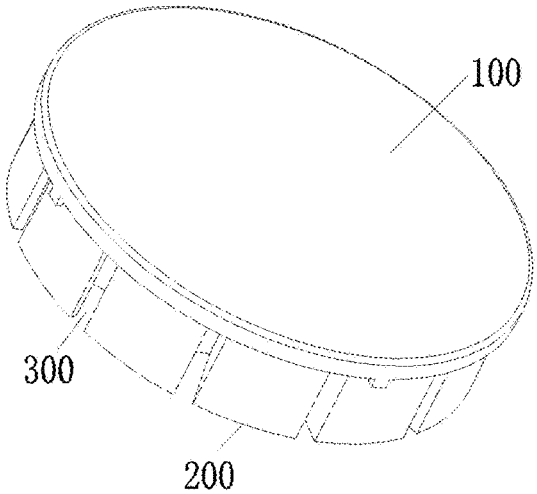
Figure 7C:
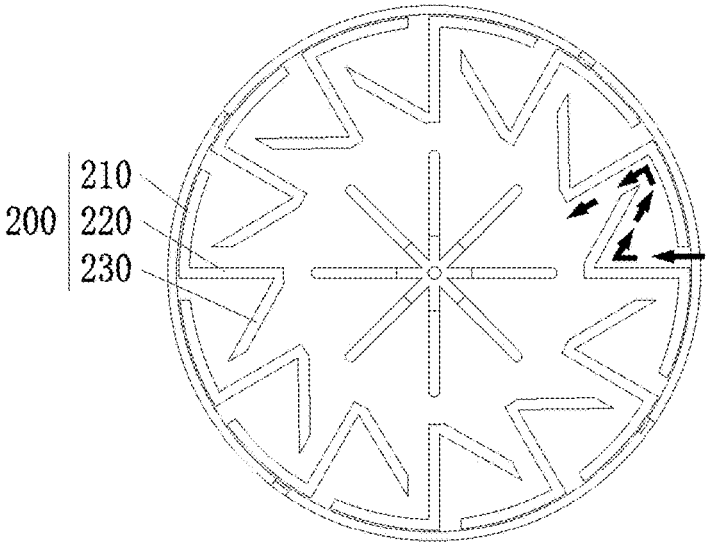
FIG. 7*c* is a front top view of the maze structure of the detection apparatus in the embodiment of FIG. 6*a;*

As shown in FIG. 7, in some other preferred embodiments, the maze passage 300 is formed by fitting two adjacent maze blocks 210 spaced at intervals. Each maze block 210 has the same structure, including a head mound 210, a middle mound 220 and a tail mound 230. The head mound 210 and the tail mound 230 are disposed at or near two ends of the middle mound 220 respectively and are orientated differently. For example, the first mound 210 is extended to the right side from one end of the second mound 220 and the third mound 230 is extended to the left side from the other end of the second mound 220. The maze block 210 can be regarded as further optimization of the basic composition unit similar to a "it" shape, and the first mound 211 of the first blocking part 201 and the third mound 213 of the second blocking part 202 are overlapped to form one part.

The maze blocks 210 are disposed on the surface of the base 100 in circles and at intervals in a circumferential direction, and the maze block 210 are disposed on the base 100 in the same orientation. Since the maze blocks 200 have a certain height, an annular protruding structure is formed on the side surface of the base 100, and a chamber 101 is formed in the center of the circle.

An included angle between the middle mound 220 and the tail mound 230 is an acute angle, and the tail mound 230 of the previous maze block 210 is extended near a junction of the head mound 210 and the middle mound 220 of the next maze block, thus forming a maze passage 300 therebetween. The middle mound 220 and the tail mound 230 of the previous maze block 210 form a third mound 213 and a fourth mound 214 of the second blocking part 202 respectively, and the head mound 210 and the middle mound 220 of the next maze block 210 form a first mound 211 and a second mound 212 of the first blocking part 201 respectively.

As shown in FIG. 6, the overall shape of the upper cover 2 can be a hollow cylinder, of which the lower surface is empty to form a second opening 503, the central area of the upper surface is empty to form a first opening 502, and the internal cavity is hollow to form a detection cavity 501. Meanwhile, the outer side of the first opening 502 on the upper surface is provided with an annular support platform 504 for setting the maze part of the base 100, and the support platform 504 can be fitted with the lower surface of the maze part to avoid contact with the detection chamber to a large extent, so that the light or smoke outside can only pass through the maze part and then enter the detection cavity 501 to be detected.

The detection component 3 includes a bottom plate 400 provided with a first emitting tube 401, a second emitting tube 402, and a receiving tube 403, and the first emitting tube 401 and the second emitting tube 402 are disposed on the bottom plate 400 in a manner of being scatteringly fitted to the receiving tube 403. That is, the optical signals emitted by the first emitting tube 401 and the second emitting tube 402 cannot be directly received by the receiving tube 403, but need to be scattered or reflected by other media (such as to-be-detected smoke).

For example, as shown in FIGS. 8-13, there may be one, two or more screens 404, and the screens may be located between the first emitting tube 401 and the receiving tube 403 and between the second emitting tube 402 and the receiving tube 403 respectively, or located in a common region between the three to control the emitting angles of the two emitting tubes, so that the optical signals are not directly received by the receiving tube 403.

The above are two main manners to achieve scattering fitting. For these two implementations, in order to make the central optical axis of the two emitting tubes not coincide, parts can be further disposed from the perspective of planar dislocation and three-dimensional dislocation.

I. Planar Dislocation

The layout of the structure is as shown in FIGS. 8-9 and FIGS. 10-11. The first emitting tube 401, the second emitting tube 402, and the receiving tube 403 are disposed on the bottom plate 400 with their respective center axes coplanar or parallel with each other, for example, their respective center axes are all parallel to the surface or center surface of the bottom plate 400. In short, the central axes of the three can be coplanar or parallel to the plane where they are located. Moreover, the first emitting tube 401, the second emitting tube 402 and the receiving tube 403 are disposed on the bottom plate 400 in a triangular shape to avoid that the first emitting tube 401 and the second emitting tube 402 have the same emitting angle. In addition, although the control over the angles of the emitting tubes is implemented based on the screen 404 in the embodiment of FIGS. 5 and 8, this does not indicate that it is mandatory, and a shading member or lens disposed at the front end of the emitting tube may also be used.

II. Three-Dimensional Dislocation

Figure 12:
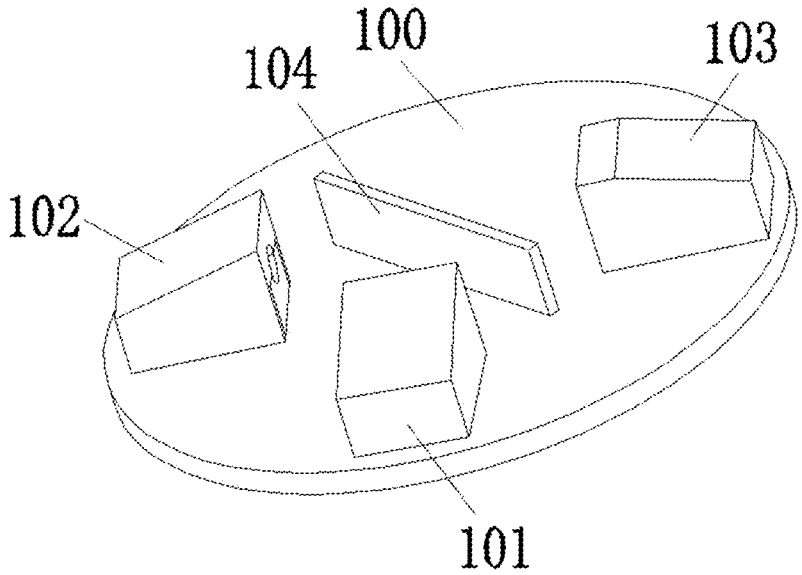
FIG. 12 is a schematic three-dimensional structural diagram of a detection component according to another embodiment (that is, Embodiment 3) of the present invention.
Figure 13A:
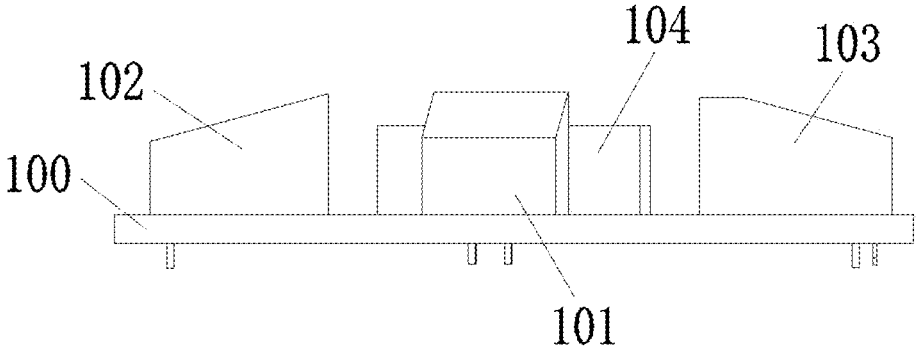
FIG. 13*a* is a top view of the embodiment of FIG. 12, wherein the central line is a central axis of an emitting tube/receiving tube.

The layout of the structure is as shown in FIGS. 12-13. The first emitting tube 401, the second emitting tube 402, and the receiving tube 403 are disposed on the base plate 400 with their respective center axes tilted upward. In principle, the tilt angles of the three are not limited, but from the perspective of practical application, the tilt angles of the first emitting tube 401 and the receiving tube 403 can be the same, while the tilt angle of the second emitting tube 402 is less than that of the former (i.e., the tilt angle of the first emitting tube 401 or the receiving tube 403) so that the overall height is controllable. The first emitting tube 401, the second emitting tube 402, and the receiving tube 403 are disposed on the bottom plate 400 in a triangular shape to avoid that the first emitting tube 401 and the second emitting tube 402 have the same emitting angle.

In addition, a plane scattering angle formed by the central optical axis of the first emitting tube 401 and the central optical axis of the receiving tube 403 is referred to as a scattering angle θ1, while a plane scattering angle formed by the central optical axis of the second emitting tube 402 and the central optical axis of the receiving tube 403 is referred to as a scattering angle θ2. The angle ranges of θ1 and θ2 may be 10°-55° and 70°-140°, respectively. Therefore, light intensity data obtained by the receiving tube 403 can be denoted as scattered light intensity data of the scattering angle θ1, scattered light intensity data of the scattering angle θ2 and scattered light intensity data of the scattering angle θ12, which respectively represent the scattered light intensity data when the first emitting tube 401 acts alone, the scattered light intensity data when the second emitting tube 402 acts alone, and the scattered light intensity data when the first emitting tube 401 acts together with the second emitting tube 402.

Preferably, the first emitting tube 401 and the second emitting tube 402 should have at least two current pulses, i.e., a first current pulse and a second current pulse respectively during the same modulation cycle. Their first current pulses are independent of each other (i.e., timing sequences are different, or they are partially overlapped and the overlap is less than the detection requirements of the receiving tube 403, so that the two current pulses can be independent of each other in the practical effect), and the second current pulses are at least overlapped (i.e., the timing sequences are at least partially overlapped, and an overlapping width meets the detection requirements of the receiving tube 403). Therefore, the scattering light intensities of the scattering angle θ1 and the scattering angle θ2 are scattering light intensity values generated when the first current pluses of the first emitting tube 401 and the second emitting tube 402 act alone respectively, and the scattering light intensity of the scattering angle θ12 is a scattering light intensity value generated when the second current pluses of the first emitting tube 401 and the second emitting tube 402 act together. That is, the two emitting tubes 401 and 402 perform emission independently in a modulation cycle according to a prescribed modulation mode, and the receiving tube 403 can receive three pieces of scattered light intensity data in the modulation cycle. The modulated current waveform is as shown in FIGS. 4*a*-4*d*, and the actual waveform is diverse.

FIGS. 8-9, FIGS. 10-11 and FIGS. 12-13 are schematic structural diagrams of three kinds of detection components 3 respectively, whose specific structures are as follows.

Embodiment 1

Figure 8:
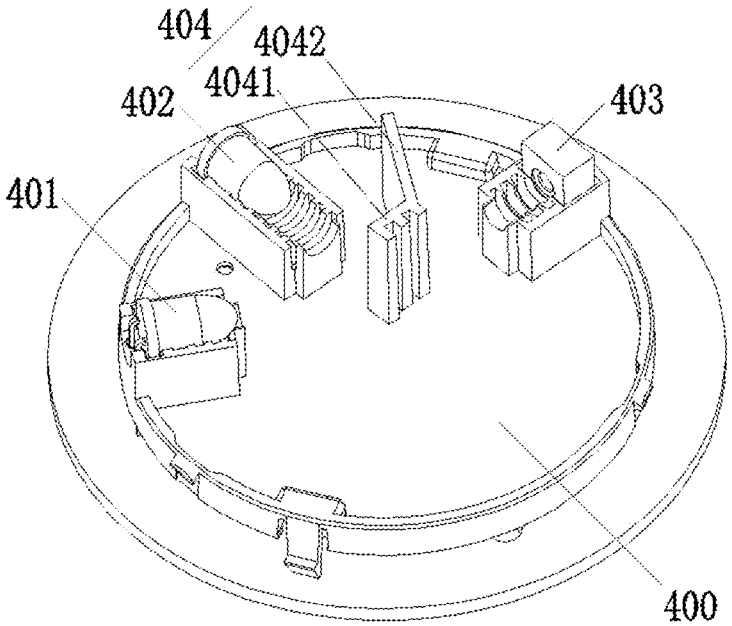
FIG. 8 is a schematic three-dimensional structural diagram of a detection component according to Embodiment 1 of FIG. 6*a* (that is, the detection component according to Embodiment 1)
Figure 9A:
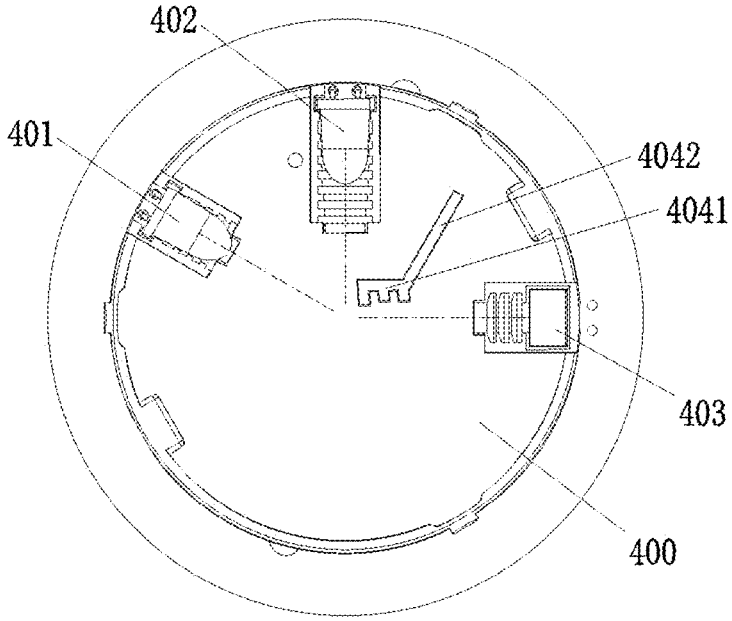
FIG. 9*a* is a top view of the embodiment of FIG. 8, wherein the center line is a central axis of an emitting tube/receiving tube, and θ1 and θ2 are angular relations between a first emitting tube and the receiving tube and between a second emitting tube and the receiving tube respectively.

As shown in FIGS. 8-9, a new photoelectric smoke fire alarm detection component includes a bottom plate 400 which is in a flat cylindrical shape. A first emitting tube 401, a second emitting tube 402, and a receiving tube 403 are disposed on the surface of the bottom plate 400. The first emitting tube 401 and the second emitting tube 402 are disposed on the bottom plate 400 in a manner of being scatteringly fitted to the receiving tube 403. That is, the optical signals emitted by the first emitting tube 401 and the second emitting tube 402 cannot be directly received by the receiving tube 403, but can be received by the receiving tube 403 only if they are scattered or reflected by other media (such as to-be-detected smoke).

In order to achieve the scattering fitting of the two emitting tubes and the receiving tube, a screen 404 is disposed on the bottom plate 400. The screen 404 includes a first blocking part 4041 and a second blocking part 4042. The first blocking part 4041 blocks a part of the emission angle of the first emitting tube 401 so that its optical signal is not directly received by the receiving tube 403, and the first blocking part 4041 and the second blocking part 4041 jointly block a part of the emission angle of the second emitting tube 402 so that its optical signal is not directly received by the receiving tube 403. Thus, the first emitting tube 401 and the second emitting tube 402 are both scatteringly fitted to the receiving tube 403.

The central optical axes of the first emitting tube 401, the second emitting tube 402 and the receiving tube 403 are located in the same plane and parallel to the surface of the bottom plate 400. The screen 404 has a certain height to make its upper edge higher than an effective emission height of the first emitting tube 401 and the second emitting tube 402. That is, the scattering fitting of the first emitting tube 401, the second emitting tube 402 and the receiving tube 403 is completed in a plane (certainly, which also includes a certain range above or below the plane), rather than three-dimensional scattering fitting beyond the top of the screen 404.

Figure 9B:
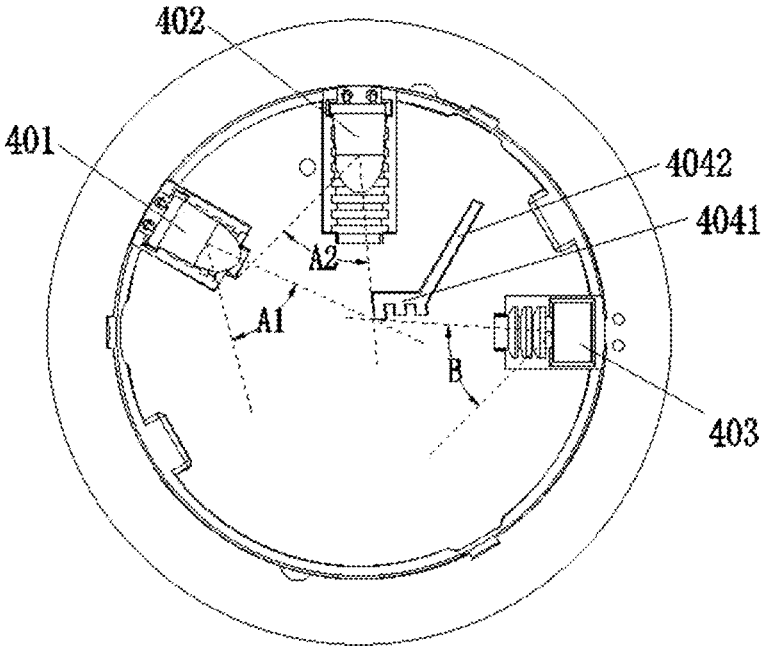
FIG. 9*b* is a schematic diagram of an actual emission/receiving angle range after the emission/receiving angle range is controlled by a screen in the embodiment of FIG. 8.

The emitting and receiving angle ranges in this embodiment are as shown in FIG. 9*b*, where three angles are marked. A1, A2 and B are actual emitting/receiving angle ranges of the first emitting tube 401, the second emitting tube 402, and the receiving tube 403, respectively. Obviously, the emitting tubes are not directly fitted to the receiving tube.

Embodiment 2

Figure 10:
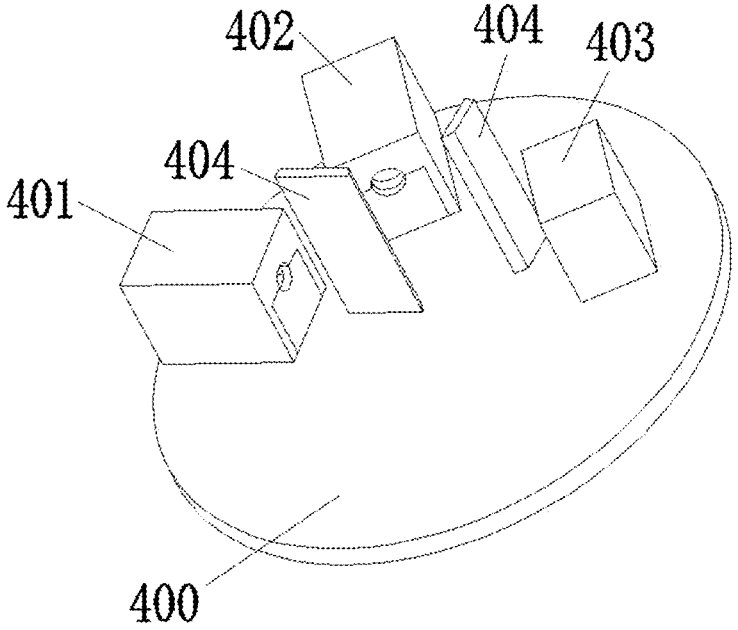
FIG. 10 is a schematic three-dimensional structural diagram of a detection component according to another embodiment (that is, Embodiment 2) of the present invention.
Figure 11A:
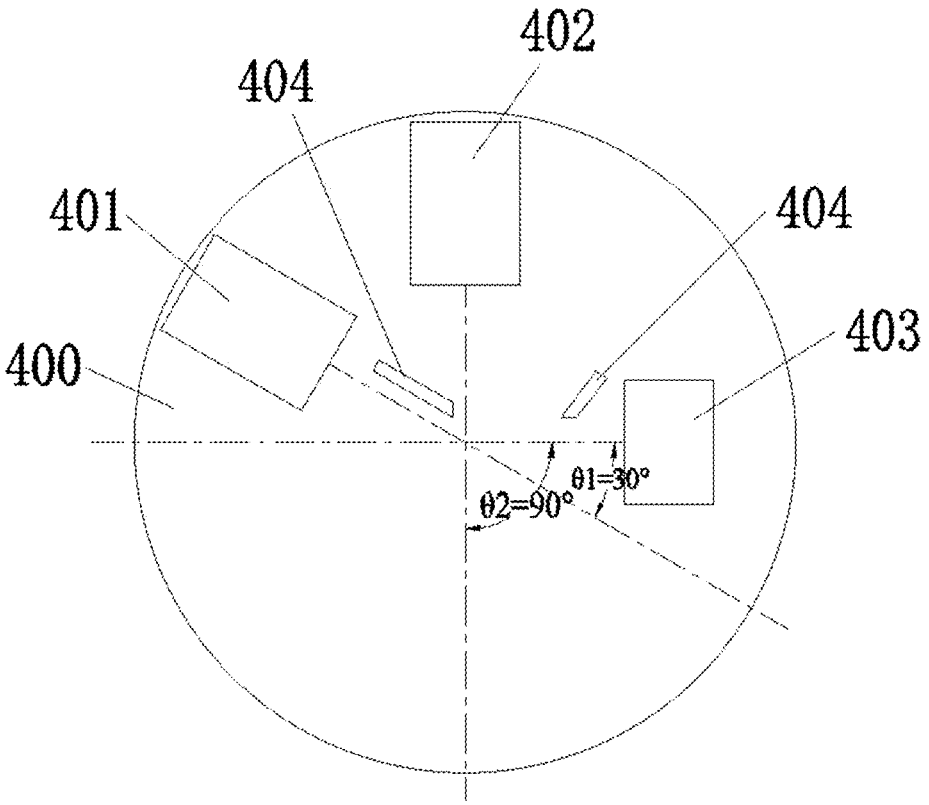
FIG. 11*a* is a side view of the embodiment of FIG. 10.

As shown in FIGS. 10-11, a new photoelectric smoke fire alarm detection component includes a bottom plate 400 which is in a flat cylindrical shape. A first emitting tube 401, a second emitting tube 402, and a receiving tube 403 are disposed on the surface of the bottom plate 400. The first emitting tube 401 and the second emitting tube 402 are disposed on the bottom plate 400 in a manner of being scatteringly fitted to the receiving tube 403. That is, the optical signals emitted by the first emitting tube 401 and the second emitting tube 402 cannot be directly received by the receiving tube 403, but can be received by the receiving tube 403 only if they are scattered or reflected by other media (such as to-be-detected smoke).

In order to achieve the scattering fitting of the two emitting tubes and the receiving tube, two screens 404 are disposed on the bottom plate 400. One of the screens 404 is disposed on a side in the front of the first emitting tube 401, so that an optical axis on the side of the first emitting tube 401 is shielded by the screen and cannot be directly received by the receiving tube 403, and the other one of the screens 404 is disposed on a side of the head of the second emitting tube 402, so that an optical axis on the side of the second emitting tube 402 is shielded by the screen and cannot be directly received by the receiving tube 403. In other words, the two screens 404 are set so that the optical signals emitted by the first emitting tube 401 and the second emitting tube 402 cannot be directly received by the receiving tube 403. All relevant structural adaptations that can meet this requirement are feasible and are not limited here.

The central optical axes of the first emitting tube 401, the second emitting tube 402, and the receiving tube 403 are located in the same plane and parallel to the surface of the bottom plate 400. The screen 404 has a certain height to make its upper edge higher than an effective emission height of the first emitting tube 401 and the second emitting tube 402, that is, the scattering fitting of the first emitting tube 401, the second emitting tube 402 and the receiving tube 403 is completed in a plane (certainly, which also includes a certain range above or below the plane), rather than three-dimensional scattering fitting beyond the top of the screen 404.

Figure 11B:
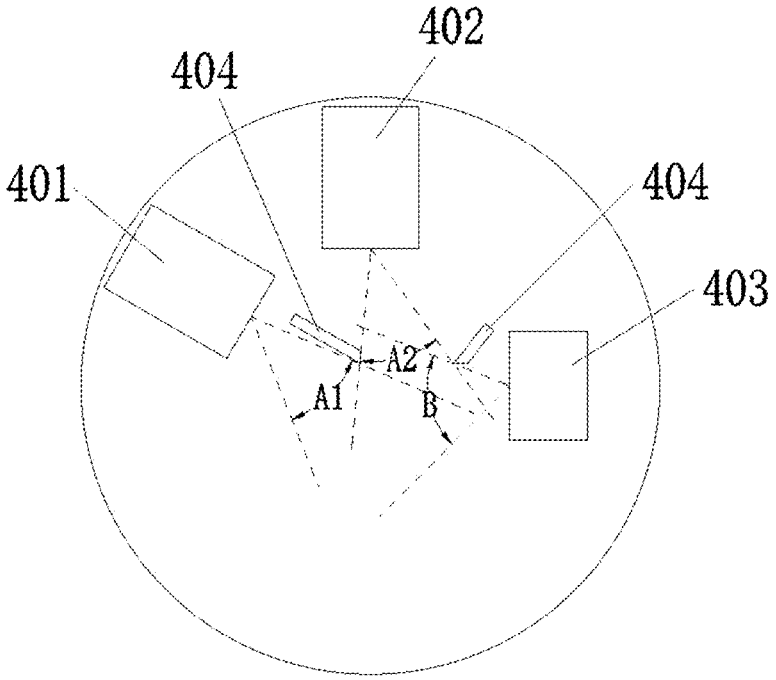
FIG. 11*b* is a schematic diagram of an actual emission/receiving angle range after the emission/receiving angle range is controlled by a screen in the embodiment of FIG. 10.

The emitting and receiving angle ranges in this embodiment are as shown in FIG. 11*b*, where three angles are marked. A1, A2 and B are actual emitting/receiving angle ranges of the first emitting tube 401, the second emitting tube 402, and the receiving tube 403, respectively. Obviously, the emitting tubes are not directly fitted to the receiving tube.

Embodiment 3

As shown in FIGS. 12-13, a new photoelectric smoke fire alarm detection component includes a bottom plate 400 which is in a flat cylindrical shape. A first emitting tube 401, a second emitting tube 402, and a receiving tube 403 are disposed on the surface of the bottom plate 400. The first emitting tube 401 and the second emitting tube 402 are disposed on the bottom plate 400 in a manner of being scatteringly fitted to the receiving tube 403. That is, the optical signals emitted by the first emitting tube 401 and the second emitting tube 402 cannot be directly received by the receiving tube 403, but can be received by the receiving tube 403 only if they are scattered or reflected by other media (such as to-be-detected smoke). The first emitting tube 401, the second emitting tube 402 and the receiving tube 403 are disposed on the bottom plate 400 in a triangular shape. An included angle between the first emitting tube 401 and the receiving tube 403 is 90°, and an included angle between the second emitting tube 402 and the receiving tube 403 is 180°.

In order to achieve the scattering fitting of the two emitting tubes and the receiving tube, a screen 404 is disposed on the bottom plate 400. The strip-shaped screen 404 is disposed in a common region between the first emitting tube 401, the second emitting tube 402 and the receiving tube 403. Moreover, the first emitting tube 401, the second emitting tube 402 and the receiving tube 403 are all obliquely disposed on the bottom plate 400 relative to the surface of the bottom plate 400. An included angle between the central axis of the first emitting tube 401 and the plane of the bottom plate 400 is consistent with an included angle between the central axis of the receiving tube 403 and the plane of the bottom plate 400. An included angle between the central axis of the second emitting tube 402 and the plane of the bottom plate 400 may be less than the former (that is, the included angle between the central axis of the receiving tube 403 and the plane of the bottom plate 400). It should be noted that the surface of the bottom plate 400 is used as a reference surface to determine the tilt relationship between the first emitting tube 401, the second emitting tube 402 and the receiving tube 403, which can also be the bottom or center surface of the bottom plate 400, or another uniquely determined virtual reference surface.

In order to achieve the direct path shielding between the emitting tubes and the receiving tube, the screen 404 should have an appropriate height, and in order to consider the shielding between the two emitting tubes at the same time, the screen 404 is tilted horizontally in the horizontal plane. Thus, the optical signals emitted by the first emitting tube 401 and the second emitting tube 402 cannot be directly received by the receiving tube 403, but are scatteringly fitted in a three-dimensional direction after crossing the top of the screen 404.

It should be noted that in this embodiment, since the included angle between the first emitting tube 401 and the receiving tube 403 is 90°, the screen 404 does not work on it in principle, but when their angle or distance change enables the optical signal emitted by the first emitting tube 401 to be received directly by the receiving tube 403, the screen 404 also needs to block the direct reception accordingly. The height and length of the screen 404 can be set according to requirements, as long as it can achieve the blocking of direct cooperation, and the specific situation is not limited.

Figure 13B:
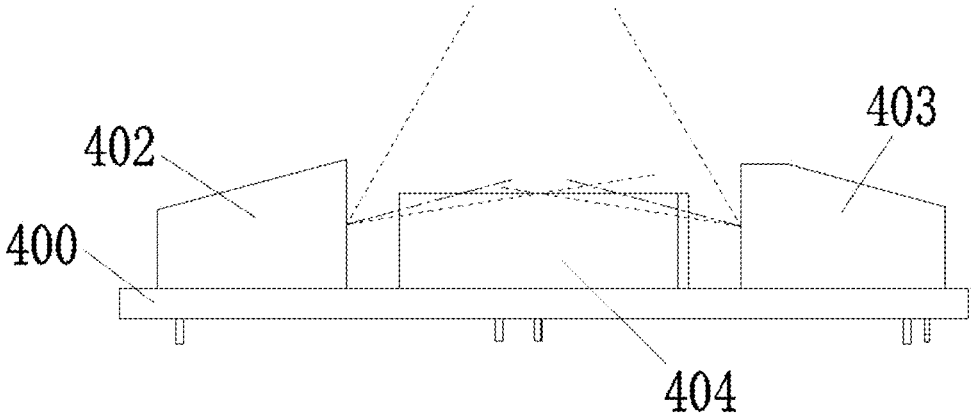
FIG. 13*b* is a schematic diagram of an actual emission/receiving angle range after the emission/receiving angle range is controlled by a screen in the embodiment of FIG. 12.

The emitting and receiving angle ranges in this embodiment are as shown in FIG. 13*b*, where two angles marked are actual emitting/receiving angle ranges of the second emitting tube 402 and the receiving tube 403, respectively. Obviously, the emitting tube is not directly fitted to the receiving tube in this case.

The invention claimed is:

1. A new photoelectric smoke fire detection and alarming method, comprising:

step 1: a data acquisition step of acquiring scattered light intensity data of samples; the scattered light intensity data of each sample comprising a scattered light intensity of a scattering angle θ1 and a scattered light intensity of a scattering angle θ2;

step 2: a data analysis step of obtaining sample parameters by calculation based on the acquired sample data, the sample parameters comprising at least one of a particle size d and a refractive index m;

step 3: a sample table generation step of forming a number of fire categories by taking any of the sample parameters calculated in the previous step as a measurement index, and determining values or value ranges of various sample parameters of each fire category to obtain a sample table; and step 4: a fire early-warning step of acquiring detection data (scattered light intensity data) of a detection sample collected in real time according to the method of step 1, obtaining sample parameters of the detection sample by calculation according to the method of step 2, and comparing the parameters of the detection sample with the sample table;

if the parameters of the detection sample are in line with the parameters of a fire category, determining it as a fire and sending an early-warning signal;

if the parameters of the detection sample are not in line with the parameters of any fire category, repeating the above detection, calculation and comparison processes at least twice and calculating mean values, and making comparison using a single mean value or multiple mean values respectively; and if the mean values are in line with the parameters of a fire category, determining it as a fire and sending an early-warning signal; and if the mean values are still not in line with the parameters of any fire category, continuously collecting detection data and constantly repeating the calculation and comparison processes.

2. The fire alarming method of claim 1, wherein the particle size d and the refractive index m are calculated according to the following methods respectively:

the scattered light intensity $I_S$ satisfying: $Is=I_r+I\iota$;

wherein $I_r$ and $I\iota$ denote quantities perpendicular to and parallel to a scattering surface respectively, and satisfy:

$$I_r = \frac{1}{k^2r^2}|S_1(\theta)|^2 I_{r0} = \frac{\lambda^2}{4\pi^2r^2}|S_1(\theta)|^2 I_{r0} = \frac{\lambda^2}{4\pi^2r^2} i_1(\theta) I_0 \sin^2\varphi$$

$$I_l = \frac{1}{k^2r^2}|S_2(\theta)|^2 I_{l0} = \frac{\lambda^2}{4\pi^2r^2}|S_2(\theta)|^2 I_{l0} = \frac{\lambda^2}{4\pi^2r^2} i_2(\theta) I_0 \cos^2\varphi$$

In the above formulas, $i(\theta,\varphi)=|S(\theta,\varphi)|^2$ is an intensity function and is deduced from the following formula:

$$I_s = \frac{|S(\theta,\varphi)|^2}{k^2r^2} I_0 = \frac{i(\theta,\varphi)}{k^2r^2} I_0$$

$i1(\theta)$ and $i2(\theta)$ are respectively:

$$i_1(\theta) = |S_1(\theta)|^2 = \left|\sum_{l=1}^{\infty} \frac{2l+1}{l(l+1)}(a_l\pi_l + b_l\tau_l)\right|^2$$

$$i_2(\theta) = |S_2(\theta)|^2 = \left|\sum_{l=1}^{\infty} \frac{2l+1}{l(l+1)}(a_l\tau_l + b_l\pi_l)\right|^2$$

wherein $\alpha\iota$ and $b\iota$ are:

$$a_l = \frac{\psi_l(\alpha)\psi_1'(\beta) - m\psi_l'(\alpha)\psi_l(\beta)}{\zeta_l^{(1)}(\alpha)\psi_l'(\beta) - m\zeta_l^{(1)\prime}(\alpha)\psi_l(\beta)}$$

$$b_l = \frac{m\psi_l(\alpha)\psi_l'(\beta) - \psi_l'(\alpha)\psi_l(\beta)}{m\zeta_l^{(1)}(\alpha)\psi_l'(\beta) - \zeta_l^{(1)\prime}(\alpha)\psi_l(\beta)}$$

$\alpha$ and $\beta$ satisfy:

$\alpha=\pi d/\lambda$;

$\beta=ma$;

in the above formulas, $\theta$ denotes a scattering angle, $\phi$ denotes an azimuth angle, r denotes a distance, $\lambda$ denotes a detected light wavelength, all of which are known parameters, and then the particle size d and the refractive index m can be obtained by iterative calculation according to the above formulas in combination with the scattered light intensity $I_S$.

3. The fire alarming method of claim 1, wherein step 2 is replaced with:

step 2: a data analysis step of obtaining sample parameters by calculation based on the sample data acquired in the previous step, the sample parameters comprising at least one of a light intensity ratio n and particle distribution e;

wherein the light intensity ratio n and the particle distribution e are calculated according to the following methods respectively:

the light intensity ratio n satisfying:

$n=I_S1/I_S2$;

wherein $I_S1$ denotes the scattered light intensity of the scattering angle $\theta1$, and $I_S2$ denotes the scattered light intensity of the scattering angle $\theta2$; and the particle distribution e satisfying:

$e=D(d, m)$; or $e=D(n)$, wherein d denotes the particle size of a particle, m denotes the refractive index, and n denotes the light intensity ratio.

4. The fire alarming method of claim 1, wherein the sample parameters further comprise a smoke rising rate 1, a smoke increment y, a smoke concentration a, and a smoke curvature k; and the smoke rising rate 1, the smoke increment y, the smoke concentration a, and the smoke curvature k are calculated according to the following methods respectively:

firstly, drawing a data curve of scattered light intensities of fire smoke particles by taking time as a horizontal axis and light intensity values as a vertical axis; and then, in the drawn data curve of the scattered light intensities of the fire smoke particles, taking a slope from a point A to a point B of the light intensity curve as the smoke rising slope 1, taking an increment from the point A to the point B of the light intensity curve as the smoke increment y, taking the value of a point a on the light intensity curve as the smoke concentration a, and taking a change rate between a point k1 and a point k2 of the light intensity curve as the smoke curvature.

5. The fire alarming method of claim 1, wherein in step 1, the scattered light intensity data of each sample further comprises scattered light intensity data of a scattering angle $\theta12$.

6. The fire alarming method of claim 1, wherein in step 1, the samples comprise fire samples and interference source samples; and meanwhile, in step 3, when the sample table is obtained, the sample table is caused to cover sample parameters of various fire samples but not cover sample parameters of various interference source samples.

7. The fire alarming method of claim 1, wherein the method further comprises an exiting step and a daily monitoring step;

step 5: the exiting step of comparing the detection data acquired in step 4 with a set threshold if it is not determined as a fire in step 4;

if the detection data is less than the set threshold, determining that the environment is back to normal, and exiting the method of step 1 to step 4; if the detection data is greater than or equal to the set threshold, determining that the environment is not back to normal, and repeating the step of fire early-warning in step 4 until the step is exited; and step 6: the daily monitoring step of collecting scattered light intensity data regularly, and comparing the acquired scattered light intensity value with a set threshold; if the collected value is greater than or equal to the set threshold, performing the detection and alarming method of step 1 to step 4; and if the collected value is less than the set threshold, repeating this step until the detection and alarming method of step 1 to step 4 is started; or collecting scattered light intensity data regularly, and comparing an actual increment of the acquired scattered light intensity value relative to an environmental reference value with an increment threshold; if the actual increment is greater than or equal to the increment threshold, performing the detection and alarming method of step 1 to step 4; and if the actual increment is less than the increment threshold, repeating this step.

8. A new photoelectric smoke fire detection and alarming apparatus, comprising:

a data acquisition module configured to acquire scattered light intensity data of samples; the scattered light intensity data of each sample comprising a scattered light intensity of a scattering angle θ1 and a scattered light intensity of a scattering angle θ2;

a data analysis module configured to obtain sample parameters by calculation based on the acquired sample data, the sample parameters comprising at least one of a particle size d and a refractive index m;

a sample table generation module configured to form a number of fire categories by taking any of the sample parameters calculated by the data analysis module as a measurement index, and determine values or value ranges of various sample parameters of each fire category to obtain a sample table; and a fire early-warning module configured to acquire detection data (scattered light intensity data) of a detection sample collected in real time through the data acquisition module, obtain parameters of the detection sample by calculation through the data analysis module, and compare the parameters of the detection sample with the sample table obtained by the sample table generation module;

if the parameters of the detection sample are in line with the parameters of a fire category, determine it as a fire and send an early-warning signal;

if the parameters of the detection sample are not in line with the parameters of any fire category, repeat the above detection, calculation and comparison processes at least twice and calculate mean values, and make comparison using a single mean value or multiple mean values respectively; and if the mean values are in line with the parameters of a fire category, determine it as a fire and send an early-warning signal; and if the mean values are still not in line with the parameters of any fire category, continuously collect detection data and constantly repeat the calculation and comparison processes.

9. The apparatus of claim 8, wherein in the data analysis module, the particle size d and the refractive index m are calculated according to the following methods respectively:

the scattered light intensity $I_S$ satisfying: $Is=I_r+I\iota$;

wherein $I_r$ and Iι denote quantities perpendicular to and parallel to a scattering surface respectively, and satisfy:

$$I_r = \frac{1}{k^2r^2}|S_1(\theta)|^2 I_{r0} = \frac{\lambda^2}{4\pi^2r^2}|S_1(\theta)|^2 I_{r0} = \frac{\lambda^2}{4\pi^2r^2} i_1(\theta) I_0 \sin^2\varphi$$

-continued $$I_l = \frac{1}{k^2r^2}|S_2(\theta)|^2 I_{l0} = \frac{\lambda^2}{4\pi^2r^2}|S_2(\theta)|^2 I_{l0} = \frac{\lambda^2}{4\pi^2r^2} i_2(\theta) I_0 \cos^2\varphi$$

in the above formulas, $i(\theta,\varphi)=|S(\theta,\varphi)|^2$ is an intensity function and is deduced from the following formula:

$$I_s = \frac{|S(\theta,\varphi)|^2}{k^2r^2} I_0 = \frac{i(\theta,\varphi)}{k^2r^2} I_0$$

i1(θ) and i2(θ) are respectively:

$$i_1(\theta) = |S_1(\theta)|^2 = \left|\sum_{l=1}^{\infty} \frac{2l+1}{l(l+1)}(a_l\pi_l + b_l\tau_l)\right|^2$$

$$i_2(\theta) = |S_2(\theta)|^2 = \left|\sum_{l=1}^{\infty} \frac{2l+1}{l(l+1)}(a_l\tau_l + b_l\pi_l)\right|^2$$

wherein αι and bι are:

$$a_l = \frac{\psi_l(\alpha)\psi_1'(\beta) - m\psi_l'(\alpha)\psi_l(\beta)}{\zeta_l^{(1)}(\alpha)\psi_l'(\beta) - m\zeta_l^{(1)\prime}(\alpha)\psi_l(\beta)}$$

$$b_l = \frac{m\psi_l(\alpha)\psi_l'(\beta) - \psi_l'(\alpha)\psi_l(\beta)}{m\zeta_l^{(1)}(\alpha)\psi_l'(\beta) - \zeta_l^{(1)\prime}(\alpha)\psi_l(\beta)}$$

α and β satisfy:

$\alpha=\pi d/\lambda$;

$\beta=m\alpha$;

in the above formulas, θ denotes a scattering angle, ϕ denotes an azimuth angle, r denotes a distance, λ denotes a detected light wavelength, all of which are known parameters, and then the particle size d and the refractive index m can be obtained by iterative calculation according to the above formulas in combination with the scattered light intensity $I_S$.

10. The apparatus of claim 8, wherein the data analysis module is replaced with:

a data analysis module configured to obtain sample parameters by calculation based on the acquired sample data, the sample parameters comprising at least one of a light intensity ratio n and particle distribution e;

wherein the light intensity ratio n and the particle distribution e are calculated according to the following methods respectively:

the light intensity ratio n satisfying:

$n=I_S1/I_S2$;

wherein $I_S1$ denotes the scattered light intensity of the scattering angle θ1, and $I_S2$ denotes the scattered light intensity of the scattering angle θ2; and the particle distribution e satisfying:

e=D(d, m); or e=D(n), wherein d denotes the particle size of a particle, m denotes the refractive index, and n denotes the light intensity ratio.

11. The apparatus of claim 8, wherein the sample parameters further comprise a smoke rising rate 1, a smoke increment y, a smoke concentration a, and a smoke curvature k; and the smoke rising rate 1, the smoke increment y, the smoke concentration a, and the smoke curvature k are calculated according to the following methods respectively:

firstly, drawing a data curve of scattered light intensities of fire smoke particles by taking time as a horizontal axis and light intensity values as a vertical axis; and then, in the drawn data curve of the scattered light intensities of the fire smoke particles, taking a slope from a point A to a point B of the light intensity curve as the smoke rising slope 1, taking an increment from the point A to the point B of the light intensity curve as the smoke increment y, taking the value of a point a on the light intensity curve as the smoke concentration a, and taking a change rate between a point k1 and a point k2 of the light intensity curve as the smoke curvature.

12. The apparatus of claim 8, wherein the scattered light intensity data of each sample further comprises scattered light intensity data of a scattering angle θ12.

13. The apparatus of claim 8, wherein in step 1, the samples comprise fire samples and interference source samples; and meanwhile, in step 3, when the sample table is obtained, the sample table is caused to cover sample parameters of various samples and any interference source sample is not in line with any of the fire categories upon comparison with the sample table, that is, sample parameters of various interference source samples are not covered.

14. The apparatus of claim 8, wherein the apparatus further comprises an exit judging module and a daily monitoring module;

the exit judging module is configured to judge whether to exit the fire early-warning module, compare the acquired detection data with a set threshold if the fire early-warning module determines that it is not a fire; if the detection data is less than the set threshold, determine that the environment is back to normal, and exit the fire early-warning module; if the detection data is greater than or equal to the set threshold, determine that the environment is not back to normal, and repeat the execution of the fire early-warning module until the fire early-warning module is exited; and the daily monitoring module is configured to perform monitoring in a daily non-fire situation; compare scattered light intensity data collected regularly with a set threshold; if the collected value is greater than or equal to the set threshold, start the execution of the fire early-warning module; and if the collected value is less than the set threshold, repeat the execution of the daily monitoring module; or compare an actual increment of the scattered light intensity value relative to an environmental reference value with an increment threshold; if the actual increment is greater than or equal to the increment threshold, start the execution of the fire early-warning module; and if the actual increment is less than the increment threshold, repeat the execution of the module.

15. A new photoelectric smoke fire detection and alarming system, comprising an optical detection apparatus and a detection and alarming apparatus, wherein the detection component comprises a bottom plate (400) provided with a first emitting tube (401), a second emitting tube (402), and a receiving tube (403), the first emitting tube (401) and the second emitting tube (402) are both scatteringly fitted to the receiving tube (403), and central axes of the first emitting tube (401) and the second emitting tube (402) are not overlapped;

the detection component further comprises a scattering mechanism so that optical signals emitted by the first emitting tube (401) and the second emitting tube (402) cannot be directly received by the receiving tube (403); the scattering mechanism comprises a screen (404) disposed on the bottom plate (400) and located between the first emitting tube (401) and/or the second emitting tube (402) and the receiving tube (403); and the detection and alarming apparatus is the photoelectric smoke fire detection and alarming apparatus according to claim 8.

16. The system of claim 15, wherein the first emitting tube (401), the second emitting tube (402), and the receiving tube (403) are disposed on the bottom plate (400) with their respective center axes disposed horizontally; or the first emitting tube (401), the second emitting tube (402), and the receiving tube (403) are disposed on the bottom plate (400) with their respective center axes disposed obliquely.

17. The system of claim 15, wherein the bottom plate (400) is further provided with two screens (404); one of the screens (404) is disposed on a side in the front of the first emitting tube (401), so that an optical axis on the side of the first emitting tube (401) is shielded by the screen and is not directly received by the receiving tube (403), and the other one of the screens (404) is disposed on a side of the head of the second emitting tube (402), so that an optical axis on the side of the second emitting tube (402) is shielded by the screen and is not directly received by the receiving tube (403); or the bottom plate (400) is further provided with a screen (404) comprising a first shielding part (4041) and a second shielding part (4041), the first shielding part (4041) shields part of an emitting angle of the first emitting tube (401) so that its optical signal is not directly received by the receiving tube (403), and the first shielding part (4041) and the second shielding part (4041) jointly shield part of an emitting angle of the second emitting tube (402) so that its optical signal is not directly received by the receiving tube (403); or the bottom plate (400) is further provided with a strip-shaped screen (404) disposed in a common region between the first emitting tube (401), the second emitting tube (402), and the receiving tube (403); and the screen (404) is disposed obliquely and horizontally in the horizontal direction, so that the optical signals emitted by the first emitting tube (401) and the second emitting tube (402) cannot be directly received by the receiving tube (403), but are scatteringly fitted in a three-dimensional direction after crossing the top of the screen (404).

18. The system of claim 15, wherein an angle θ1 between the central axis of the first emitting tube (401) and the central axis of the second emitting tube (402) is 10-55°; and/or an angle θ2 between the central axis of the second emitting tube (402) and the central axis of the receiving tube (403) is 70-140°.

19. The system of claim 15, wherein the detection component further comprises an optical maze comprising a base (100), a maze part is disposed on one side of the base (100), and a detector is fitted to the side to form a fire alarm;

the maze part has a maze passage (300) formed by fitting of a first blocking part (301) and a second blocking part (302), the first blocking part (301) comprises a first mound (311) and a second mound (312), and the second blocking part (302) comprises a third mound (313) and a fourth mound (314); an included angle between the third mound (313) and the fourth mound (314) is an acute angle, and the fourth mound (314) is extended into a region between the first mound (311) and the second mound (312); and the fourth mound (314) is extended towards a junction of the first mound (311) and the second mound (312) to form a Z-shaped maze passage.

20. The system of claim 15, wherein the maze passage (300) is formed by fitting two adjacent maze blocks (210) spaced at an interval, the maze blocks (210) each comprise a head mound (210), a middle mound (220) and a tail mound (230); the head mound (210) and the tail mound (230) are disposed at two ends of the middle mound (220) respectively and are orientated differently;

an included angle between the middle mound (220) and the tail mound (230) is an acute angle, and the maze blocks (210) are disposed on the base (100) in the same orientation;

and the tail mound (230) of the previous maze block (210) is extended into a region between the head mound (210) and the middle mound (220) of the next maze block (210); the middle mound (220) and the tail mound (230) of the previous maze block (210) form a third mound (313) and a fourth mound (314) of a second blocking part (302) respectively, and the head mound (210) and the middle mound (220) of the next maze block (210) form a first mound (311) and a second mound (312) of a first blocking part (301) respectively.

* * * * *